US009044915B2

(12) United States Patent
Hoshino et al.

(10) Patent No.: US 9,044,915 B2
(45) Date of Patent: Jun. 2, 2015

(54) SHEET PROCESSING DEVICE AND IMAGE FORMING SYSTEM

(71) Applicants: Tomomichi Hoshino, Kanagawa (JP); Kiyoshi Hata, Tokyo (JP); Keisuke Sugiyama, Tokyo (JP); Atsushi Kikuchi, Kanagawa (JP); Makoto Hidaka, Tokyo (JP); Satoshi Saito, Kanagawa (JP); Shohichi Satoh, Kanagawa (JP); Takao Watanabe, Kanagawa (JP); Takuya Sano, Kanagawa (JP)

(72) Inventors: Tomomichi Hoshino, Kanagawa (JP); Kiyoshi Hata, Tokyo (JP); Keisuke Sugiyama, Tokyo (JP); Atsushi Kikuchi, Kanagawa (JP); Makoto Hidaka, Tokyo (JP); Satoshi Saito, Kanagawa (JP); Shohichi Satoh, Kanagawa (JP); Takao Watanabe, Kanagawa (JP); Takuya Sano, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 14/152,378

(22) Filed: Jan. 10, 2014

(65) Prior Publication Data

US 2014/0203487 A1 Jul. 24, 2014

(30) Foreign Application Priority Data

Jan. 18, 2013 (JP) ..... 2013-007733

(51) Int. Cl.

| | |
|---|---|
| ***B31F 1/00*** | (2006.01) |
| ***B65H 45/12*** | (2006.01) |
| ***B65H 37/04*** | (2006.01) |
| ***B65H 45/18*** | (2006.01) |

(Continued)

(52) U.S. Cl.

CPC . *B31F 1/00* (2013.01); *B65H 45/16* (2013.01); *B65H 45/04* (2013.01); *B65H 45/12* (2013.01); *B31F 1/0035* (2013.01); *B31F 1/0006* (2013.01); *B65H 2801/27* (2013.01); *B65H 37/04* (2013.01); *B65H 45/18* (2013.01); *B65H 2301/51232* (2013.01); *B65H 2701/13212* (2013.01)

(58) Field of Classification Search

CPC ..... B31F 1/00; B31F 1/0006; B31F 1/0035; B65H 45/12; B65H 45/04; B65H 2801/27

USPC ..... 270/32, 45, 58.07

See application file for complete search history.

(56) References Cited

U.S. PATENT DOCUMENTS

| | | | | |
|---|---|---|---|---|
| 6,905,118 | B2 * | 6/2005 | Yamada et al. | 270/8 |
| 7,431,273 | B2 * | 10/2008 | Kamiya et al. | 270/37 |
| 7,568,688 | B2 * | 8/2009 | Nomura et al. | 270/58.12 |

(Continued)

FOREIGN PATENT DOCUMENTS

| | | |
|---|---|---|
| JP | 2009-143674 | 7/2009 |
| JP | 2012-030964 | 2/2012 |

*Primary Examiner* — Leslie A Nicholson, III

(74) *Attorney, Agent, or Firm* — Harness, Dickey & Pierce, P.L.C.

(57) ABSTRACT

A saddle stitching binding device includes an additional folding roller unit that presses a fold line portion of a folded sheet bundle and performs additional folding, and a unit movement mechanism that causes the additional folding roller unit to reciprocate in the width direction of the sheet bundle. The saddle stitching binding device further includes a sheet supporting device that is located on a movement path of the additional folding roller unit and supports the lower surface side of the sheet bundle when the sheet bundle after pressed is conveyed to the downstream side. In the saddle stitching binding device, a supporting position at which the sheet supporting device supports the sheet bundle and a retreat position at which the sheet supporting device permits the additional folding roller unit to move are set to the sheet supporting device.

10 Claims, 17 Drawing Sheets

(51) Int. Cl.
*B65H 45/16* (2006.01)
*B65H 45/04* (2006.01)

(56) References Cited

U.S. PATENT DOCUMENTS

| | | | | |
|---|---|---|---|---|
| 7,575,229 | B2 * | 8/2009 | Kushida | 270/58.08 |
| 7,866,650 | B2 * | 1/2011 | Nomura et al. | 270/58.12 |
| 7,922,163 | B2 * | 4/2011 | Ichihashi et al. | 270/58.12 |
| 8,162,305 | B2 * | 4/2012 | Hattori et al. | 270/58.09 |
| 2009/0152789 | A1 | 6/2009 | Kikkawa et al. | |
| 2010/0148417 | A1 | 6/2010 | Suzuki et al. | |
| 2010/0239393 | A1 | 9/2010 | Suzuki et al. | |
| 2010/0258994 | A1 | 10/2010 | Kikkawa et al. | |
| 2010/0303585 | A1 | 12/2010 | Asami et al. | |
| 2010/0304946 | A1 * | 12/2010 | Chase et al. | 493/442 |
| 2010/0310340 | A1 | 12/2010 | Suzuki et al. | |
| 2011/0064541 | A1 | 3/2011 | Kikkawa et al. | |
| 2011/0091259 | A1 | 4/2011 | Kobayashi et al. | |
| 2011/0103863 | A1 | 5/2011 | Asami et al. | |
| 2011/0103919 | A1 | 5/2011 | Furuhashi et al. | |
| 2011/0103921 | A1 | 5/2011 | Suzuki et al. | |
| 2011/0229287 | A1 | 9/2011 | Suzuki | |
| 2012/0028780 | A1 | 2/2012 | Sugiyama et al. | |
| 2012/0087765 | A1 | 4/2012 | Suzuki | |

* cited by examiner

SHEET PROCESSING DEVICE AND IMAGE FORMING SYSTEM

CROSS-REFERENCE TO RELATED APPLICATIONS

The present application claims priority to and incorporates by reference the entire contents of Japanese Patent Application No. 2013-007733 filed in Japan on Jan. 18, 2013.

BACKGROUND OF THE INVENTION

1. Field of the Invention

The present invention relates to a sheet processing device and an image forming system. Specifically, the invention relates to the sheet processing device having a function of performing folding processing on a sheet-like recording medium (hereinafter, in the specification, simply referred to as a "sheet") such as paper, recording paper, and transfer paper, and the image forming system including the sheet processing device.

2. Description of the Related Art

Conventionally, among post-processing devices that are used in combination with an image forming apparatus such as a copying machine, there is a post-processing device that stitches the sheet center portion(s) of one or a plurality of sheets and folds the center portion of a sheet bundle by a pair of folding rollers installed in parallel in the sheet folding direction so as to bind a saddle-stitched booklet.

Furthermore, also known is an additional folding technique in which an additional folding roller is moved along a fold line after saddle stitching-center folding so as to strengthen the fold line of a saddle-stitched book after the folding processing.

Known is an invention disclosed in Japanese Laid-open Patent Publication No. 2009-143674 as the additional folding technique. This invention relates to a sheet folding device including a conveying unit that conveys a transported sheet or sheet bundle, a first folding unit that performs folding processing on the sheet or the sheet bundle conveyed by the conveying unit, and a second folding unit that reciprocates on the sheet or the sheet bundle subjected to the folding processing by the first folding unit in the direction substantially orthogonal to the sheet conveyance direction so as to perform additional folding on the sheet or the sheet bundle. The sheet folding device further includes a switching unit that switches the conveying unit between a state where a conveyance force can be transmitted to the sheet or the sheet bundle and a state where the conveyance force cannot be transmitted to the sheet or the sheet bundle, and a common driving source that drives the switching unit and the second folding unit. In the sheet folding device, the first folding unit is constituted by a pair of rollers for folding while the sheet or the sheet bundle passes through a roller nip and a plate that presses the sheet or the sheet bundle into the roller nip. Furthermore, the second folding unit is constituted by a plate-like sheet supporting member that supports the sheet or the sheet bundle subjected to the folding processing from the lower side and a pressurized roller that moves on a fold line of the sheet or the sheet bundle located on the sheet supporting member along the fold line.

In the invention as described in Japanese Laid-open Patent Publication No. 2009-143674, the sheet discharged from an image forming apparatus is subjected to center folding processing of folding the sheet in half and stitching, and then saddle stitching binding processing of performing half-folding processing. Subsequently, the additional folding roller (second folding unit) is moved along the sheet fold portion to pressurize the sheet fold portion against the supporting plate supporting the lower surface side of the sheet. In this manner, the fold portion of the saddle-stitched book after the folding processing is strengthened.

In the configuration in which the sheet bundle supported on the supporting plate is folded by the additional folding roller, a pair of additional folding rollers cannot be moved along the fold portion of the sheet bundle because of the supporting plate. For this reason, additional folding by using the pair of additional folding rollers cannot be executed.

When the supporting plate is not provided, there arises a possibility that drooping of a sheet front end and drooping of a sheet rear end are occurred. The occurrence of the drooping of the sheet front end and the drooping of the sheet rear end causes a problem in conveyance performance of the sheet bundle. When the conveyance performance of the sheet bundle is bad, an additional folding position is deviated or the sheet bundle deflects at the time of the additional folding, resulting in lowering of folding quality of the fold portion in some cases.

In view of the above-mentioned conventional problems, there is need to perform additional folding on a fold portion reliably while guaranteeing folding quality of the fold portion.

SUMMARY OF THE INVENTION

It is an object of the present invention to at least partially solve the problems in the conventional technology.

According to the present invention, there is provided a sheet processing device comprising: a pressing unit configured to press a fold line portion of a folded sheet bundle and perform additional folding; a movement unit configured to cause the pressing unit to reciprocate in a width direction of the sheet bundle; and a supporting unit configured to be located on a movement path of the pressing unit and supports a lower surface side of the sheet bundle when the sheet bundle after pressed is conveyed to a downstream side, wherein a supporting position at which the supporting unit supports the sheet bundle and a retreat position at which the supporting unit permits the pressing unit to move are set to the supporting unit.

The present invention also provides an image forming system including a sheet processing device, wherein the sheet processing device comprises: a pressing unit configured to press a fold line portion of a folded sheet bundle and perform additional folding; a movement unit configured to cause the pressing unit to reciprocate in a width direction of the sheet bundle; and a supporting unit configured to be located on a movement path of the pressing unit and supports a lower surface side of the sheet bundle when the sheet bundle after pressed is conveyed to a downstream side, wherein a supporting position at which the supporting unit supports the sheet bundle and a retreat position at which the supporting unit permits the pressing unit to move are set to the supporting unit.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 7 is viewed from the left side;

FIG. 23 is viewed from the left side (discharge side);

DETAILED DESCRIPTION OF THE PREFERRED EMBODIMENTS

The present invention is characterized in that a sheet supporting unit movable between a supporting position and a retreat position is provided on a movement path of a pair of additional folding rollers. The sheet supporting unit supports a sheet at the supporting position. The sheet supporting unit permits the pair of additional folding rollers to move at the retreat position.

Hereinafter, described is an embodiment of the invention with reference to the drawings.

Figure 1:
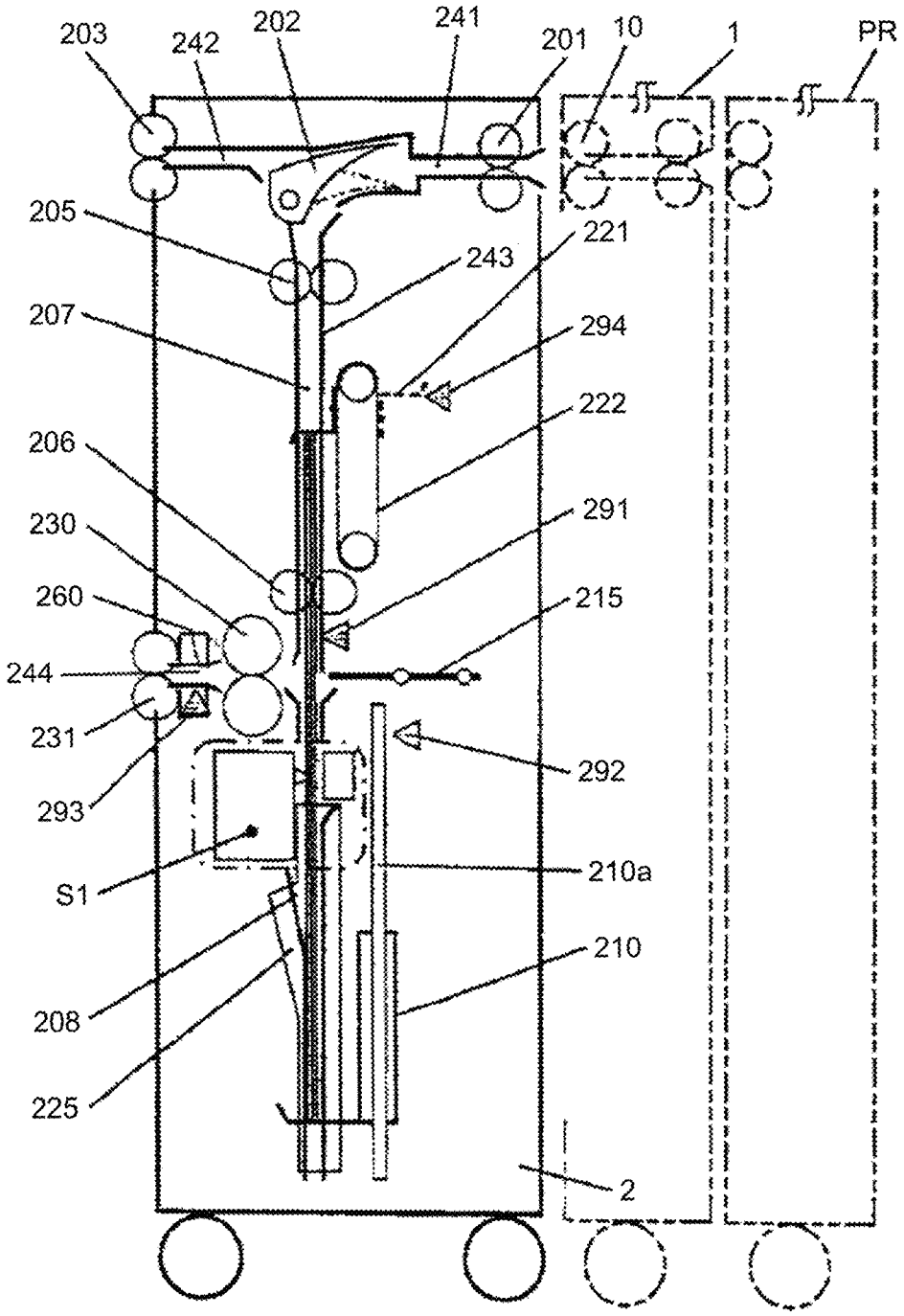
FIG. 1 is a diagram illustrating a system configuration of an image processing system that is constituted by an image forming apparatus and a plurality of sheet processing devices according to an embodiment of the present invention.

FIG. 1 is a view illustrating a system configuration of an image processing system that is constituted by an image forming apparatus and a plurality of sheet processing devices in the embodiment. In the embodiment, as the plurality of sheet processing devices, first and second sheet post-processing devices 1 and 2 are coupled in the subsequent stage of an image forming apparatus PR in this order.

The first sheet post-processing device 1 is a sheet post-processing device having a sheet bundle creating function of receiving sheets from the image forming apparatus PR one by one, aligning them in a stacking manner sequentially, and creating a sheet bundle on a stack portion. The sheet post-processing device 1 discharges the sheet bundle to the second sheet processing device 2 in the subsequent stage from sheet bundle discharging rollers 10. The second sheet post-processing device 2 is a saddle stitching binding device that receives the conveyed sheet bundle and performs saddle stitching-center folding on it (in the specification, the second sheet post-processing device is also referred to as a saddle stitching binding device).

The saddle stitching binding device 2 discharges the bound booklet (sheet bundle) as it is or discharges it to a sheet processing device in the subsequent stage. The image forming apparatus PR forms a visible image on a sheet-like recording medium based on input image data or image data of a scanned image. For example, the image forming apparatus PR corresponds to a copying machine, a printer, a facsimile, or a digital multifunctional peripheral having at least two functions thereof. The image forming apparatus PR employs a known system such as an electrophotography system and a liquid droplet ejecting system. Any image forming system may be used.

In FIG. 1, the saddle stitching binding device 2 includes an entrance conveying path 241, a sheet-through conveying path 242, and a center-folding conveying path 243. Entrance rollers 201 are provided on the entrance conveying path 241 at the most upstream portion in the sheet conveyance direction. The aligned sheet bundle is transported into the device through the entrance rollers 201 from the sheet bundle discharging rollers 10 in the first sheet post-processing device 1. In the following description, the upstream side in the sheet conveyance direction is referred to as the upstream side simply and the downstream side in the sheet conveyance direction is referred to as the downstream side simply.

A bifurcating claw 202 is provided on the entrance conveying path 241 at the downstream side of the entrance rollers 201. The bifurcating claw 202 is installed in the horizontal direction in FIG. 1 to bifurcate the conveying direction of the sheet bundle into the sheet-through conveying path 242 and the center-folding conveying path 243. The sheet-through conveying path 242 is a conveying path that extends from the entrance conveying path 241 horizontally and guides the sheet bundle to a processing device (not illustrated) or a discharge tray in the subsequent stage. The sheet bundle is discharged to the subsequent stage by discharging upper rollers 203. The center-folding conveying path 243 is a conveying path that extends from the bifurcating claw 202 downward in the perpendicular direction and on which saddle stitching and center folding processing are performed on the sheet bundle.

The center-folding conveying path 243 includes a bundle carriage guide upper plate 207 and a bundle carriage guide lower plate 208. The bundle carriage guide upper plate 207 guides the sheet bundle at the upper side of a folding plate 215 for center folding. The bundle carriage guide lower plate 208 guides the sheet bundle at the lower side of the folding plate 215. The bundle carriage guide upper plate 207 is provided with bundle carriage upper rollers 205, a rear end hitting claw 221, and bundle carriage lower rollers 206 in this order from the upper side. The rear end hitting claw 221 is provided to stand on a rear end hitting claw driving belt 222 that is driven by a driving motor (not illustrated). The rear end hitting claw 221 hits (presses) the rear end of the sheet bundle to the side of a movable fence, which will be described later, with reciprocating rotation operation by the rear end hitting claw driving belt 222 so as to perform an alignment operation of the sheet bundle. When the sheet bundle is transported and is elevated for center folding, the rear end hitting claw 221 is retreated from the center-folding conveying path 243 on the bundle carriage guide upper plate 207 (position indicated by a dashed line in FIG. 1).

A reference numeral 294 denotes a rear end hitting claw home position (HP) sensor for detecting a home position of the rear end hitting claw 221. The rear end hitting claw HP sensor 294 detects, as the home position, the position indicated by the dashed line in FIG. 1 (position indicated by a solid line in FIG. 2) to which the rear end hitting claw 221 retreats from the center-folding conveying path 243. The rear end hitting claw 221 is controlled based on the home position.

The bundle carriage guide lower plate 208 is provided with a saddle-stitching stapler S1, saddle-stitching jogger fences 225, and the movable fence 210 in this order from the upper side. The bundle carriage guide lower plate 208 is a guide plate that receives the sheet bundle conveyed through the bundle carriage guide upper plate 207. A pair of saddle-stitching jogger fences 225 are installed in the width direction of the bundle carriage guide lower plate 208. The movable fence 210 against (on) which the front end of the sheet bundle abuts (is supported) and that is movable upwardly and downwardly is provided on a lower portion of the bundle carriage guide lower plate 208.

The saddle-stitching stapler S1 is a stapler for stitching the center portion of the sheet bundle. The movable fence 210 moves upwardly and downwardly in a state of supporting the front end of the sheet bundle so as to locate a center position of the sheet bundle at a position opposed to the saddle-stitching stapler S1. At this position, staple processing, that is, saddle stitching is performed on the sheet bundle. The movable fence 210 is supported by a movable fence driving mechanism 210*a* and is movable from a position of a movable fence HP sensor 292 at the upper side in FIG. 1 to a lowermost position. A movable range of the movable fence 210 against which the front end of the sheet bundle abuts is set so as to ensure a stroke capable of processing the sheet bundle of a maximum size to a minimum size that can be processed by the saddle stitching binding device 2. It is to be noted that a rack-and-pinion mechanism is used as the movable fence driving mechanism 210*a*, for example.

The folding plate 215, a pair of folding rollers 230, an additional folding roller unit 260, and discharging lower rollers 231 are provided between the bundle carriage guide upper plate 207 and the bundle carriage guide lower plate 208, that is, on a substantially center portion of the center-folding conveying path 243. Additional folding rollers are arranged on the additional folding roller unit 260 at upper and lower sides with a discharging conveying path between the pair of folding rollers 230 and the discharging lower rollers 231 interposed therebetween. The folding plate 215 can reciprocate in the horizontal direction in the drawings. A nip of the pair of folding rollers 230 is located in the operation direction of the folding plate 215 when a folding operation is performed and a discharging conveying path 244 is installed on an extended line of the nip. The discharging lower rollers 231 are provided at the most downstream position on the discharging conveying path 244 and discharge the sheet bundle subjected to the folding processing to the subsequent stage.

A sheet bundle detection sensor 291 is provided on the bundle carriage guide upper plate 207 at the lower end side. The sheet bundle detection sensor 291 detects the front end of the sheet bundle that is transported to the center-folding conveying path 243 and passes through the center-folding position. Furthermore, a fold line portion passage sensor 293 is provided on the discharging conveying path 244 and detects the front end of the center-folded sheet bundle so as to check passage of the sheet bundle.

In summary, the saddle stitching binding device 2 configured as illustrated in FIG. 1 performs saddle-stitching and center-folding operations in the manner as illustrated in the operation descriptive views from FIG. 2 to FIG. 6. That is to say, when saddle stitching-center folding is selected on an operation panel (not illustrated) of the image forming apparatus PR, a sheet bundle for which the saddle stitching-center folding has been selected is guided to the center-folding conveying path 243 side by a biasing operation of the bifurcating claw 202 in the counterclockwise direction. The bifurcating claw 202 is driven by a solenoid. It is to be noted that the bifurcating claw 202 may be driven by a motor instead of the solenoid.

Figure 2:
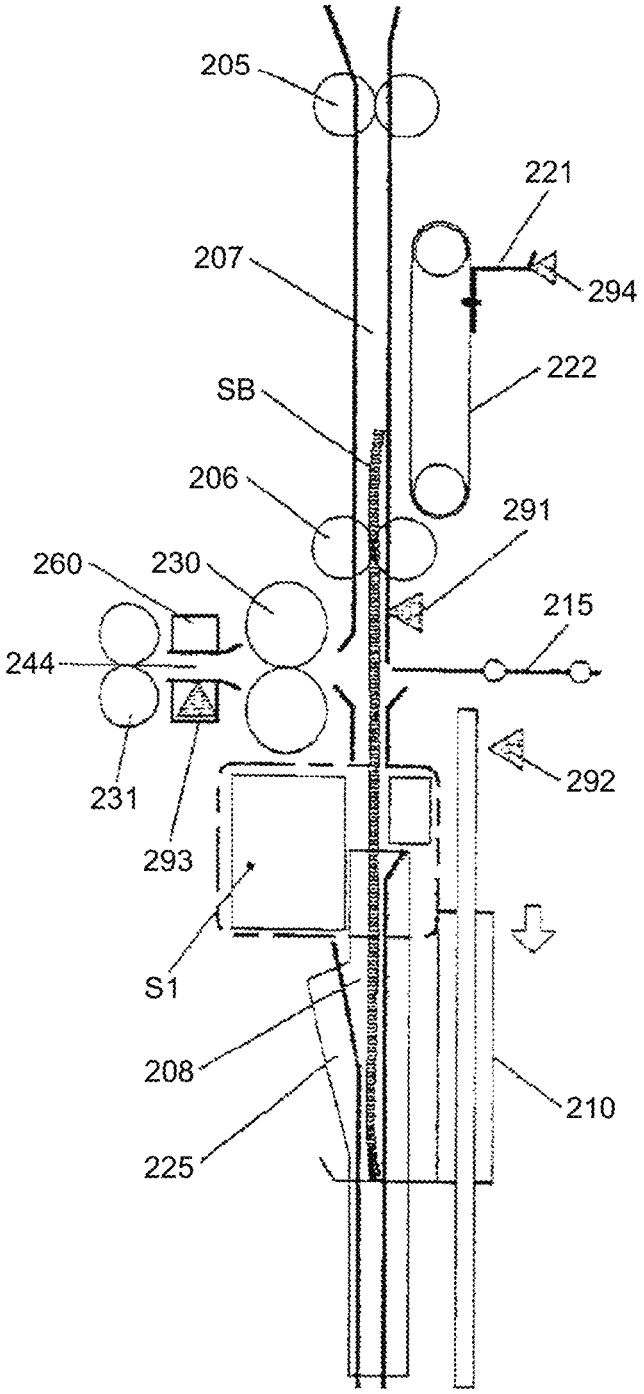
FIG. 2 is an operation descriptive diagram illustrating a saddle stitching binding device in a state where a sheet bundle is transported to a center-folding conveying path.

The entrance rollers 201 and the bundle carriage upper rollers 205 convey the sheet bundle SB transported in the center-folding conveying path 243 to the lower side on the center-folding conveying path 243. Then, the sheet bundle detection sensor 291 checks the passage of the sheet bundle SB. Thereafter, as illustrated in FIG. 2, the bundle carriage lower rollers 206 convey the sheet bundle SB to a position at which the front end thereof abuts against the movable fence 210. In this case, the movable fence 210 stands by at a stop position that is different depending on sheet size information from the image forming apparatus PR, that is, size information of each sheet bundle SB in the conveyance direction herein. At this time, in FIG. 2, the bundle carriage lower rollers 206 hold the sheet bundle SB at the nip therebetween and the rear end hitting claw 221 stands by at the home position.

Figure 3:
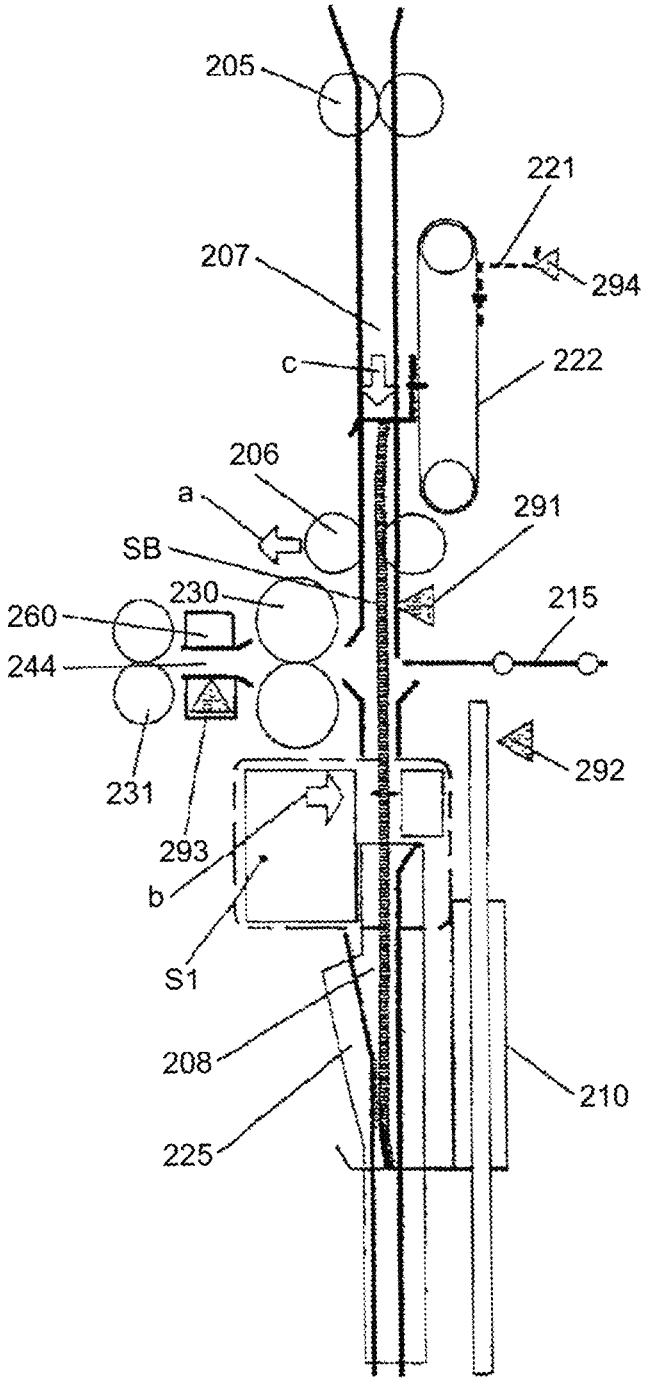
FIG. 3 is an operation descriptive diagram illustrating the saddle stitching binding device in a state where the sheet bundle is saddle-stitched.

In this state, when a nipping pressure by the bundle carriage lower rollers 206 is released (in the direction of an arrow a) as illustrated in FIG. 3 and the sheet bundle is staked while the front end of the sheet bundle abuts against the movable fence 210 and the rear end thereof is in a free state, the rear end hitting claw 221 is driven to hit the rear end of the sheet bundle SB so as to make final alignment in the conveyance direction (in the direction of an arrow c).

Subsequently, the saddle-stitching jogger fences 225 perform the alignment operation in the width direction (direction orthogonal to the sheet conveyance direction), and the movable fence 210 and the rear end hitting claw 221 perform the alignment operation in the conveyance direction. With this configuration, the alignment operations of the sheet bundle SB in the width direction and the conveyance direction are completed. In this case, pressing amounts of the rear end hitting claw 221 and the saddle-stitching jogger fences 225 are changed to appropriate values based on sheet size information and information about the number of the sheets of the sheet bundle, and sheet bundle thickness information for alignment.

When the bundle is thick, the sheet bundle cannot be aligned completely by the alignment operation once in many cases because the space in the conveying path is smaller. In this case, the number of the alignment times is increased. This can achieve a more preferable alignment state. Furthermore, time taken to stack sheets sequentially at the upstream side is increased as the number of sheets is larger. In such a case, the time until the subsequent sheet bundle SB is received becomes longer. As a result, the preferable alignment state can be achieved efficiently because time loss is not generated as the system even when the number of alignment times is increased. The number of alignment times can be also controlled in accordance with the processing time at the upstream side.

Note that the standby position of the movable fence 210 is normally set to a position at which the saddle-stitching position of the sheet bundle SB is opposed to the stitching position by the saddle-stitching stapler S1. When the sheet bundle is aligned at this position, the stitching processing can be performed at the stacked position without moving the movable fence 210 to the saddle-stitching position of the sheet bundle SB. A stitcher of the saddle-stitching stapler S1 is driven to the center portion of the sheet bundle SB in the direction of an arrow b at the standby position so as to perform stitching processing together with a clincher. In this manner, the sheet bundle SB is saddle-stitched.

The movable fence 210 is positioned by pulse control from the movable fence HP sensor 292 and the rear end hitting claw 221 is positioned by pulse control from the rear end hitting claw HP sensor 294. A central processing unit (CPU) (not illustrated) of the saddle stitching binding device 2 executes the positioning controls of the movable fence 210 and the rear end hitting claw 221.

Figure 4:
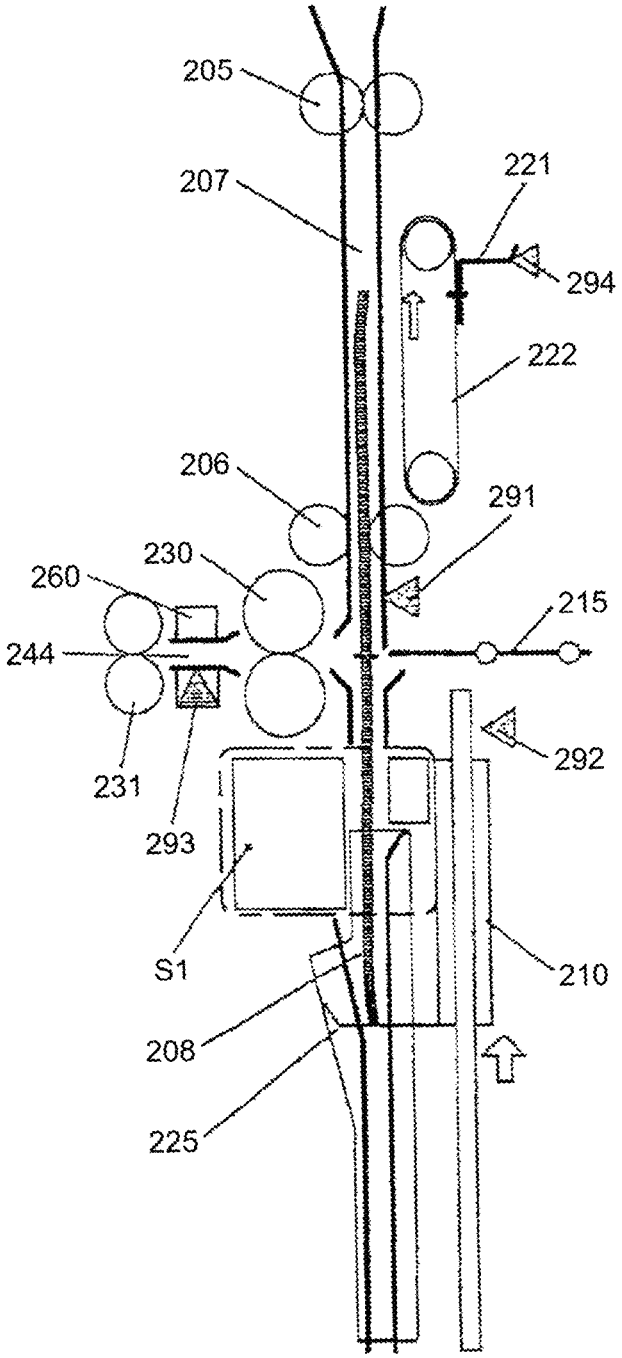
FIG. 4 is an operation descriptive diagram illustrating the saddle stitching binding device in a state where the sheet bundle is completely moved to a center-folding position.

The sheet bundle SB that has been saddle-stitched in the state as illustrated in FIG. 3 is moved to a position at which the saddle-stitched position (center position of the sheet bundle SB in the conveyance direction) is opposed to the folding plate 215 with the upward movement of the movable fence 210 in a state where pressure by the bundle carriage lower rollers 206 is released as illustrated in FIG. 4. The position is also controlled based on the detection position by the movable fence HP sensor 292.

Figure 5:
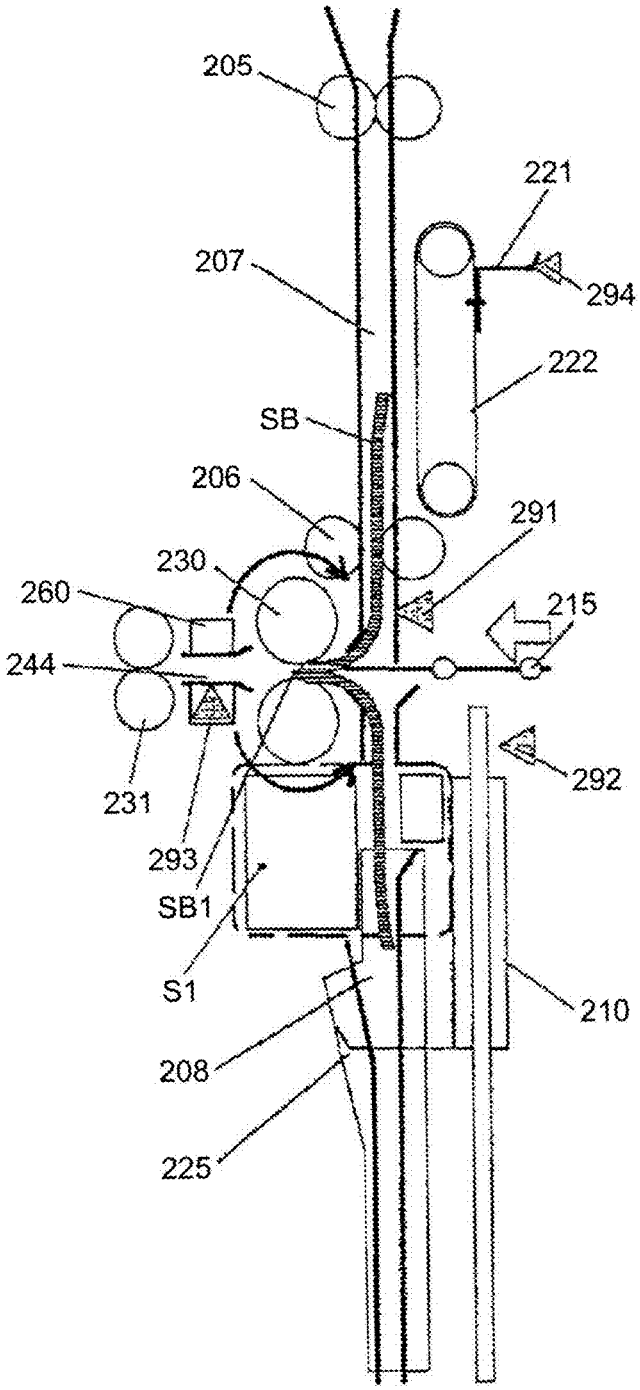
FIG. 5 is an operation descriptive diagram illustrating the saddle stitching binding device in a state where center folding processing is executed on the sheet bundle.

When the sheet bundle SB reaches the position as illustrated in FIG. 4, the folding plate 215 is moved in the direction of the nip between the pair of folding rollers 230 as illustrated in FIG. 5 and abuts against the sheet bundle SB in the vicinity of a stitched staple portion of the sheet bundle SB from the substantially orthogonal direction so as to push the sheet bundle SB to the nip side. The sheet bundle SB is pushed by the folding plate 215 so as to be guided to the nip between the pair of folding rollers 230 and be pressed into the nip between the pair of folding rollers 230 rotated previously. The pair of folding rollers 230 pressurize the sheet bundle SB pressed into the nip therebetween and convey it. The pressurizing conveyance operation makes folding on the center of the sheet bundle SB so as to form the sheet bundle SB bounded simply. FIG. 5 illustrates a state where the front end of a fold line portion SB1 of the sheet bundle SB is held by the nip between the pair of folding rollers 230 and is pressurized.

Figure 6:
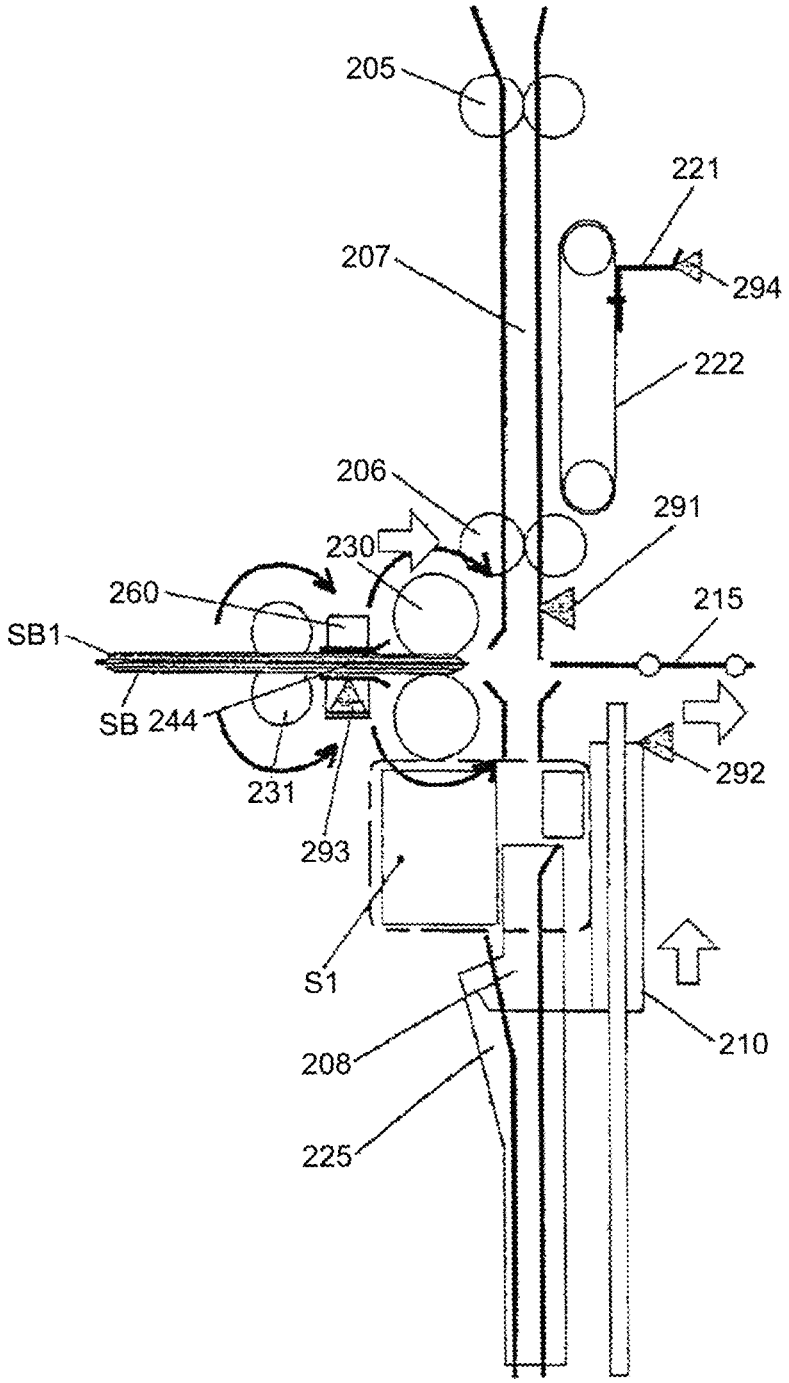
FIG. 6 is an operation descriptive diagram illustrating the saddle stitching binding device in a state where the sheet bundle is discharged after the center folding is finished.

The sheet bundle SB folded in half at the center portion in the state as illustrated in FIG. 5 is conveyed by the pair of folding rollers 230 as the sheet bundle SB as illustrated in FIG. 6, and then, is discharged to the subsequent stage while being held between the discharging lower rollers 231. When the fold line portion passage sensor 293 detects the rear end of the sheet bundle SB in this state, the folding plate 215 and the movable fence 210 return to the home positions and the bundle carriage lower rollers 206 return to be in the pressurizing state so that they prepare for the transportation of a subsequent sheet bundle SB. When the sheet bundle SB in a subsequent job has the same size and the same number of sheets, the movable fence 210 may move to the position as illustrated in FIG. 2, again, and stand by. It is to be noted that the CPU of the control circuit executes these controls.

Figure 7:
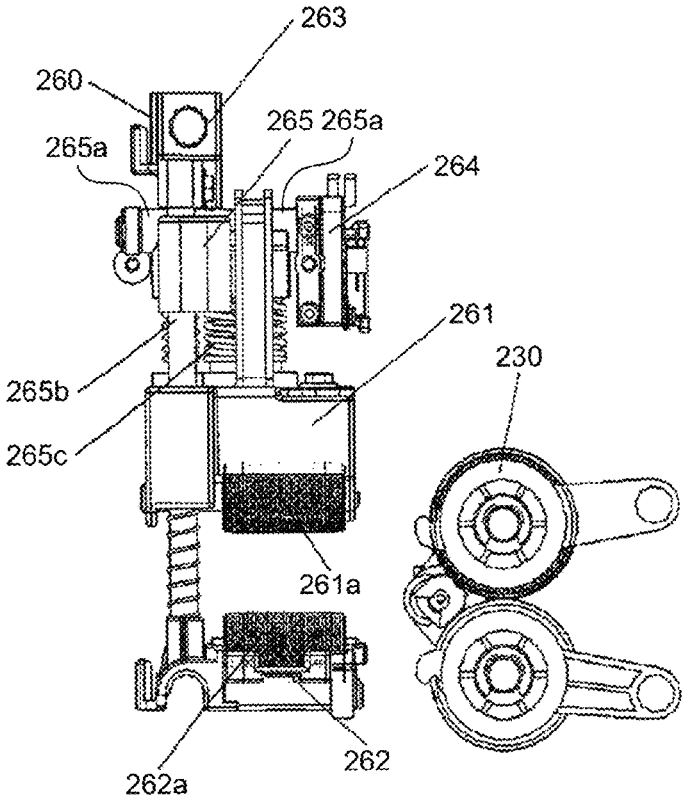
FIG. 7 is a front view illustrating main parts including an additional folding roller unit and a pair of folding rollers.
Figure 8:
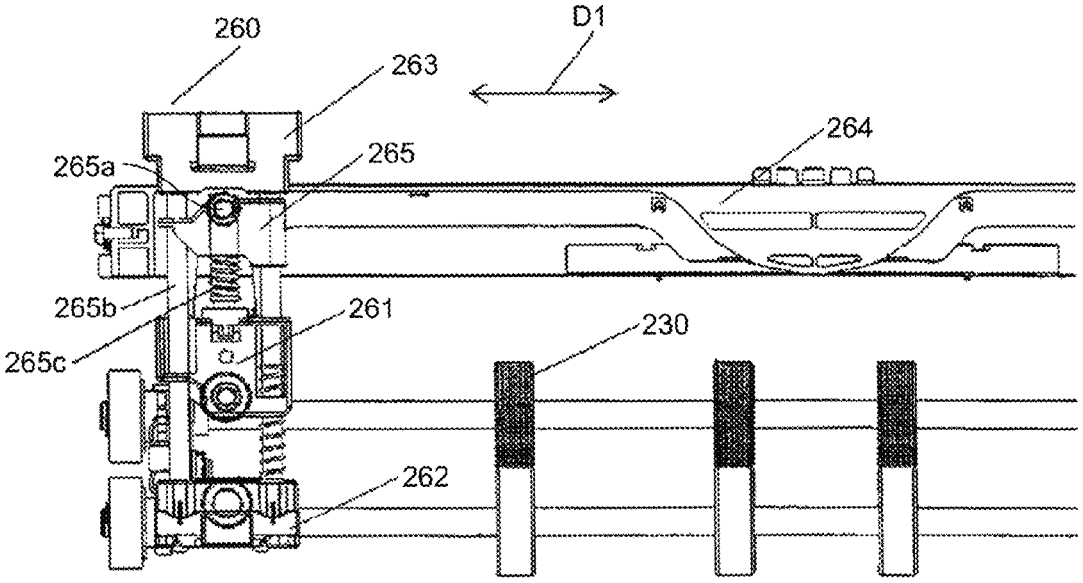
FIG. 8 is a side view illustrating main parts when

FIG. 7 is a front view illustrating main parts including the additional folding roller unit and the pair of folding rollers and FIG. 8 is a side view illustrating main parts when FIG. 7 is viewed from the left side. The additional folding roller unit 260 is installed on the discharging conveying path 244 between the pair of folding rollers 230 and the discharging lower rollers 231 and includes a unit movement mechanism 263, a guide member 264, and a pressure mechanism 265. The unit movement mechanism 263 causes the additional folding roller unit 260 to reciprocate in the depth direction in FIG. 7 (direction orthogonal to the sheet conveyance direction) along the guide member 264 by a driving source and a driving mechanism (both not illustrated). The pressure mechanism 265 is a mechanism that applies a pressure upwardly and downwardly to press the sheet bundle SB. The pressure mechanism 265 includes an additional folding roller upper unit 261 and an additional folding roller lower unit 262.

The additional folding roller upper unit 261 is supported by a supporting member **265*b* so as to be movable upwardly and downwardly with respect to the unit movement mechanism 263. The additional folding roller lower unit 262 is attached to the lower end of the supporting member 265*b* of the pressure mechanism 265 in an unmovable manner. An additional folding upper roller 261***a* of the additional folding roller upper unit 261 can make pressure contact with an additional folding lower roller 262*a*. The additional folding upper roller 261*a* and the additional folding lower roller 262*a* sandwich the sheet bundle SB at a nip therebetween so as to pressurize the sheet bundle SB. A pressing spring 265*c* that pressurizes the additional folding roller upper unit 261 by an elastic force applies a pressurizing force. Then, the additional folding roller unit 260 moves in the width direction of the sheet bundle SB (direction indicated by an arrowed line D1 in FIG. 8) in the pressurizing state, which will be described later, so as to execute additional folding on the fold line portion SB1.

Figure 9:
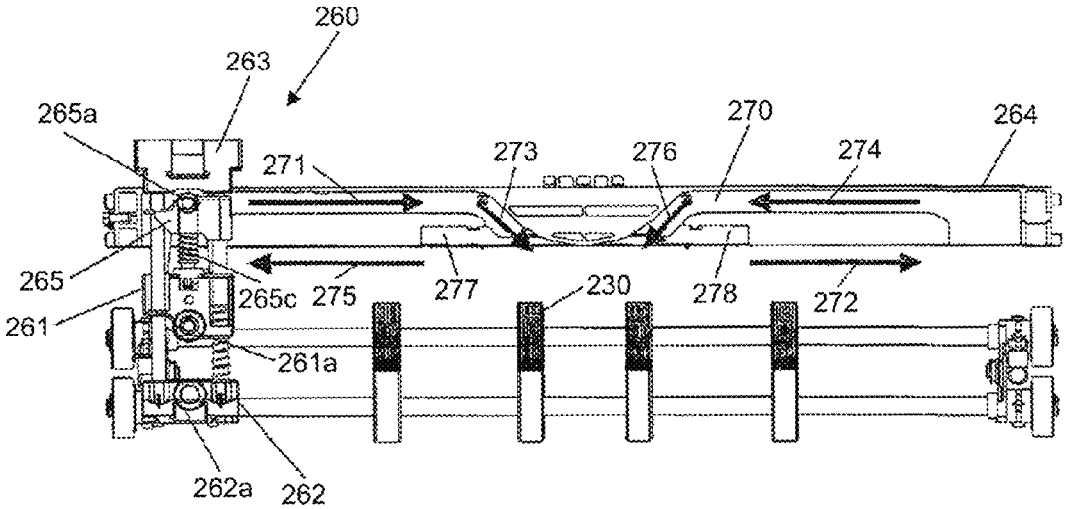
FIG. 9 is a diagram illustrating details of a guide member.

FIG. 9 is a view illustrating details of the guide member 264. The guide member 264 includes a guide path 270 for guiding the additional folding roller unit 260 in the width direction of the sheet bundle SB. The following six paths are set to the guide path 270: 1) a first guide path 271 for guiding the pressure mechanism 265 in a non-pressurizing state in forward movement, 2) a second guide path 272 for guiding the pressure mechanism 265 in a pressurizing state in the forward movement, 3) a third guide path 273 for switching the pressure mechanism 265 from the non-pressurizing state to the pressurizing state in the forward movement, 4) a fourth guide path 274 for guiding the pressure mechanism 265 in the non-pressurizing state in backward movement, 5) a fifth guide path 275 for guiding the pressure mechanism 265 in the pressurizing state in the backward movement, and 6) a sixth guide path 276 for switching the pressure mechanism 265 from the non-pressurizing state to the pressurizing state in the backward movement.

Figure 10:
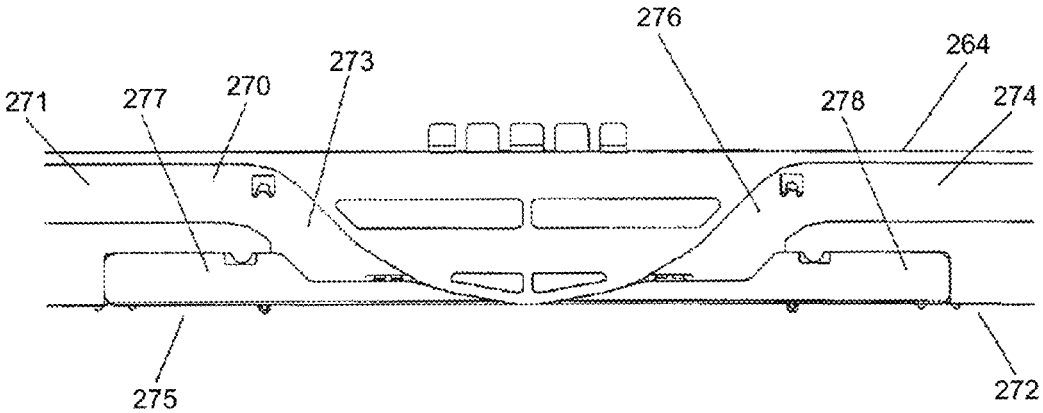
FIG. 10 is a diagram illustrating main parts of FIG. 9 in an enlarged manner and illustrates a state where a path switching claw is not switched.
Figure 11:
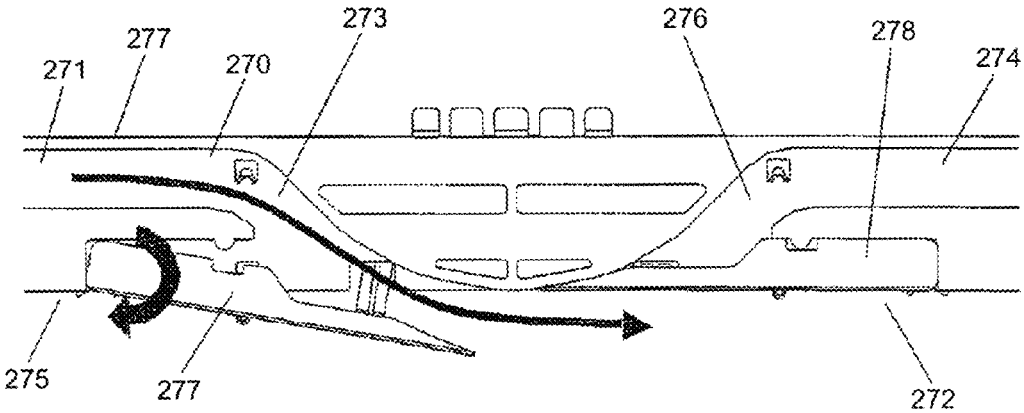
FIG. 11 is a diagram illustrating main parts of FIG. 9 in an enlarged manner and illustrates a state where the first path switching claw is switched.

FIG. 10 and FIG. 11 are views illustrating main parts of FIG. 9 in an enlarged manner. As illustrated in FIG. 10 and FIG. 11, a first path switching claw 277 and a second path switching claw 278 are installed on an intersection between the third guide path 273 and the second guide path 272 and an intersection between the sixth guide path 276 and the fifth guide path 275, respectively. The first path switching claw 277 can switch the guide path from the third guide path 273 to the second guide path 272 as illustrated in FIG. 11. The second path switching claw 278 can switch the guide path from the sixth guide path 276 to the fifth guide path 275. In contrast, the first path switching claw 277 cannot switch the guide path from the second guide path 272 to the third guide path 273. The second path switching claw 278 cannot switch the guide path from the fifth guide path 275 to the sixth guide path 276. That is to say, the guide paths cannot be switched in the revere directions. An arrowed line in FIG. 11 indicates a movement trajectory of a guide pin 265*a* (see FIGS. 7, 23, and 31).

The pressure mechanism 265 moves along the guide path 270 because the guide pin 265*a* of the pressure mechanism 265 is fitted into the guide path 270 so as to be movable in a loose fitting state. That is to say, the guide path 270 functions as a cam groove and the guide pin 265*a* functions as a cam follower of which position is changed while moving along the cam groove.

FIG. 12 to FIG. 22 are operation descriptive views of the additional folding operation by the additional folding roller unit in the embodiment.

Figure 12:
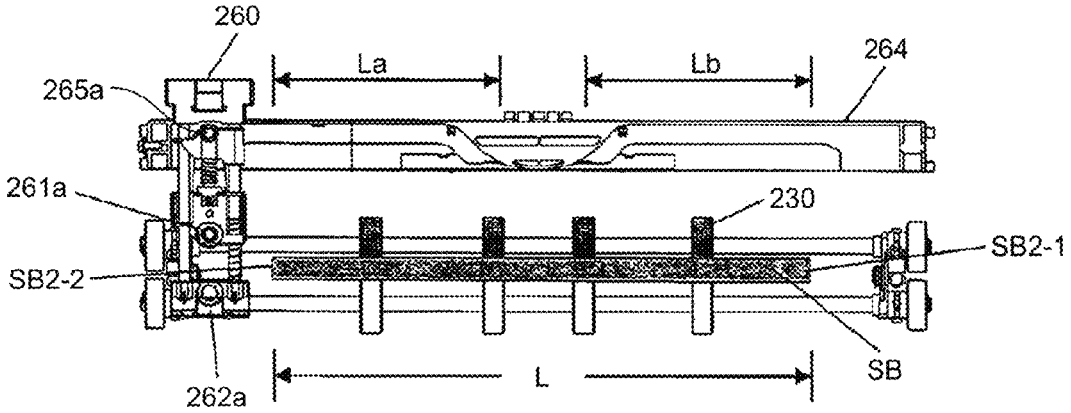
FIG. 12 is an operation descriptive diagram illustrating an initial state of an additional folding operation.

FIG. 12 illustrates a state where the sheet bundle SB folded by the pair of folding rollers 230 is conveyed to an additional folding position set previously and stops, and the additional folding roller unit 260 is located at the standby position. The state corresponds to the initial position of the additional folding operation.

Figure 13:
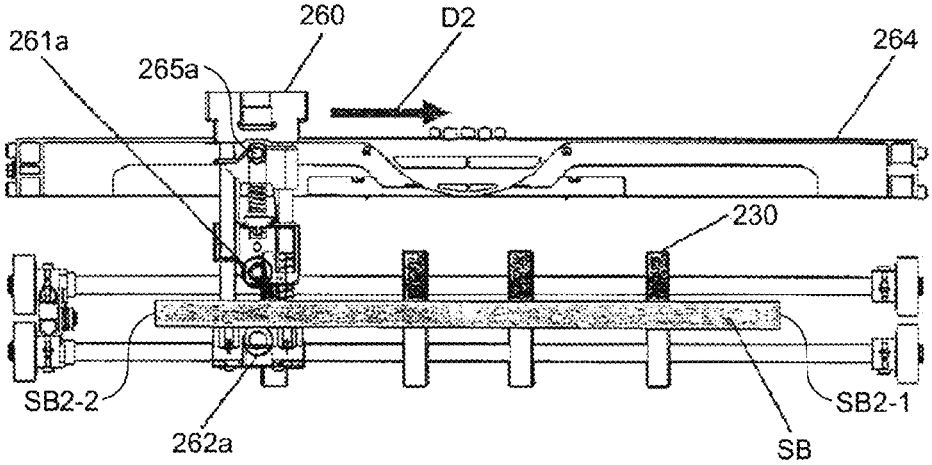
FIG. 13 is an operation descriptive diagram illustrating a state where the additional folding roller unit starts forward movement.
Figure 14:
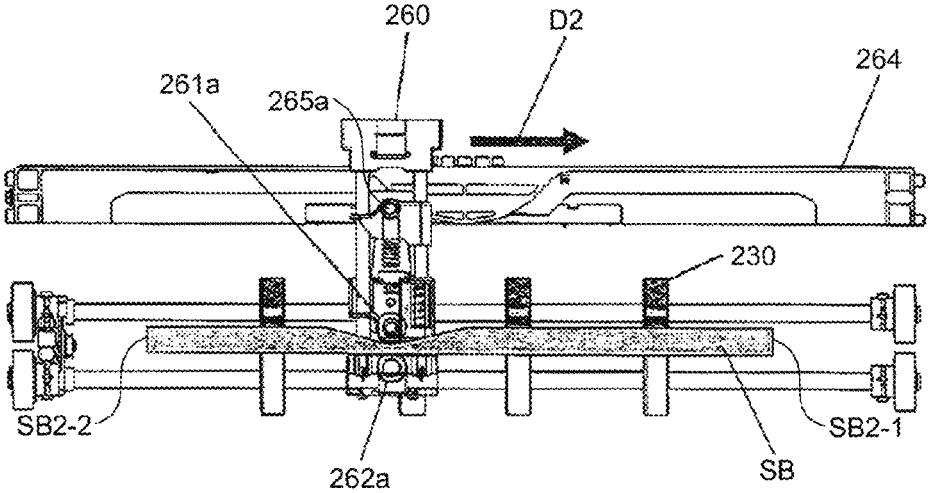
FIG. 14 is an operation descriptive diagram illustrating a state where the additional folding roller unit enters a third guide path in the vicinity of the center of the sheet bundle.

The additional folding roller unit 260 starts forward movement in the rightward direction (direction indicated by an arrowed line D2) in FIG. 13 from the initial position (FIG. 12). In this case, the pressure mechanism 265 in the additional folding roller unit 260 moves along the guide path 270 of the guide member 264 with an action by the guide pin 265*a*. The pressure mechanism 265 moves along the first guide path 271 immediately after the operation is started. In this case, the pair of additional folding rollers 261*a* and 262*a* are in the non-pressurizing states. The non-pressurizing state indicates a state where the pair of additional folding rollers 261*a* and 262*a* make contact with the sheet bundle SB and little pressure is applied to the sheet bundle SB, or a state where the pair of additional folding rollers 261*a* and 262*a* and the sheet bundle SB are separated from each other. It is to be noted that the pair of additional folding rollers 261*a* and 262*a* are constituted by the additional folding upper roller 261*a* and the additional folding lower roller 262*a* forming a pair.

Figure 15:
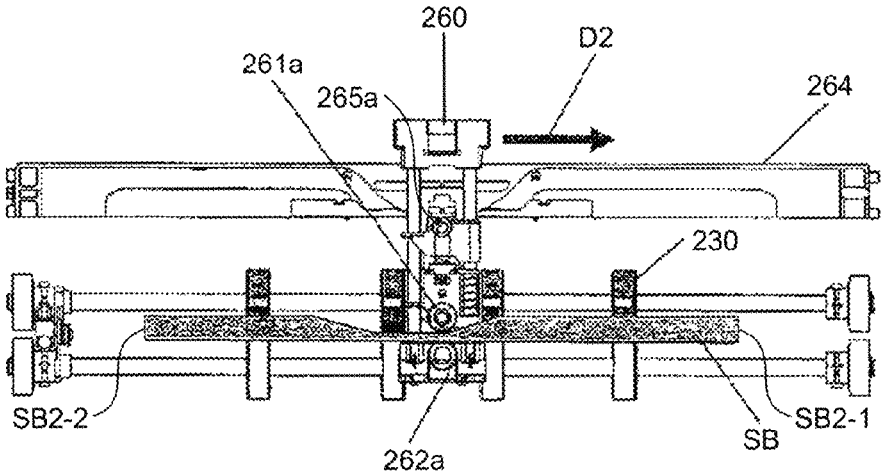
FIG. 15 is an operation descriptive diagram illustrating a state where the additional folding roller unit pushes the first path switching claw out of the way to enter a second guide path.

When the pressure mechanism 265 enters the third guide path 273 in the vicinity of the center portion of the sheet bundle SB (FIG. 14), the pressure mechanism 265 starts descending along the third guide path 273 and pushes the first path switching claw 277 out of the way to enter the second guide path 272 (FIG. 15). In this case, the pressure mechanism 265 is made into a state of pressing the additional folding roller upper unit 261 and the additional folding roller upper unit 261 abuts against the sheet bundle SB to be made into the pressurizing state.

Figure 16:
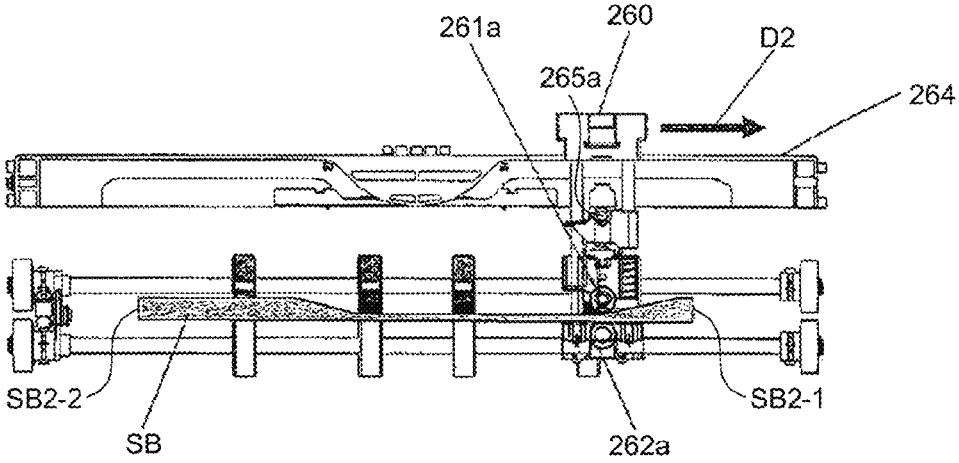
FIG. 16 is an operation descriptive diagram illustrating a state where the additional folding roller unit moves in the direction of an end while pressing the sheet bundle.
Figure 17:
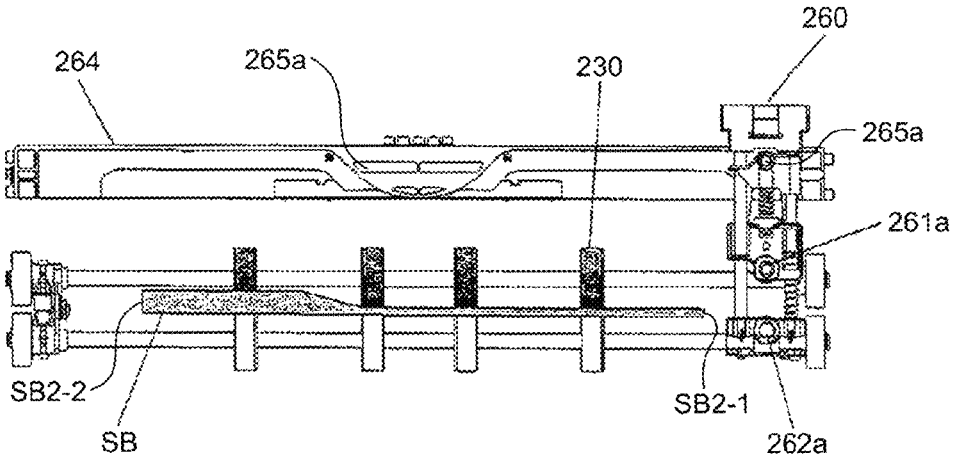
FIG. 17 is an operation descriptive diagram illustrating a state where the additional folding roller unit is moved to a final position of the forward movement along the second guide path.

The additional folding roller unit 260 further moves in the direction indicated by the arrowed line D2 in the pressurizing state (FIG. 16). In this case, the second path switching claw 278 cannot move in the reverse direction, so that the additional folding roller unit 260 is not guided to the sixth guide path 276 and moves along the second guide path 272. Then, the additional folding roller unit 260 passes through the sheet bundle SB and is located at the final position in the forward movement (FIG. 17). When the additional folding roller unit 260 moves to this position, the guide pin 265*a* of the pressure mechanism 265 shifts from the second guide path 272 to the fourth guide path 274 at the upper side. As a result, positional restriction of the guide pin 265*a* by the upper surface of the second guide path 272 is cancelled, so that the additional folding upper roller 261*a* is separated from the additional folding lower roller 262*a* to be made into the non-pressurizing state.

Figure 18:
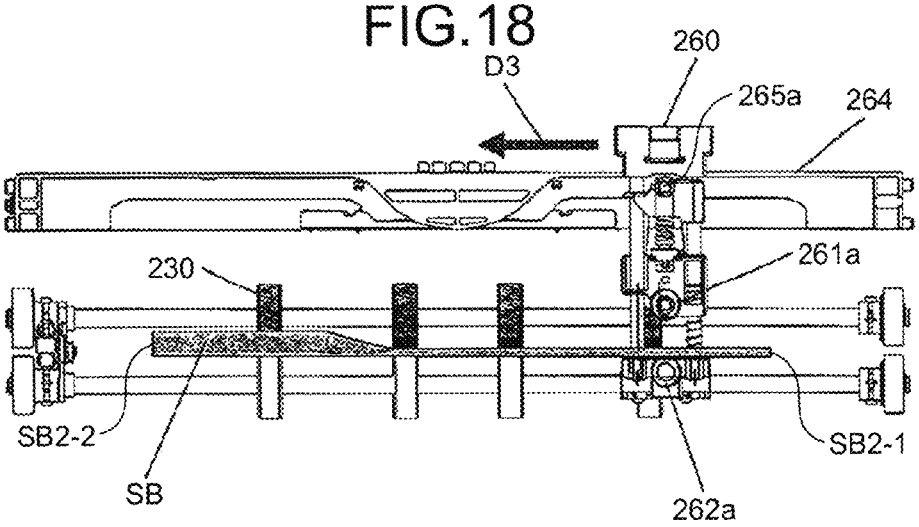
FIG. 18 is an operation descriptive diagram illustrating a state where the additional folding roller unit starts backward movement from the final position of the forward movement.
Figure 19:
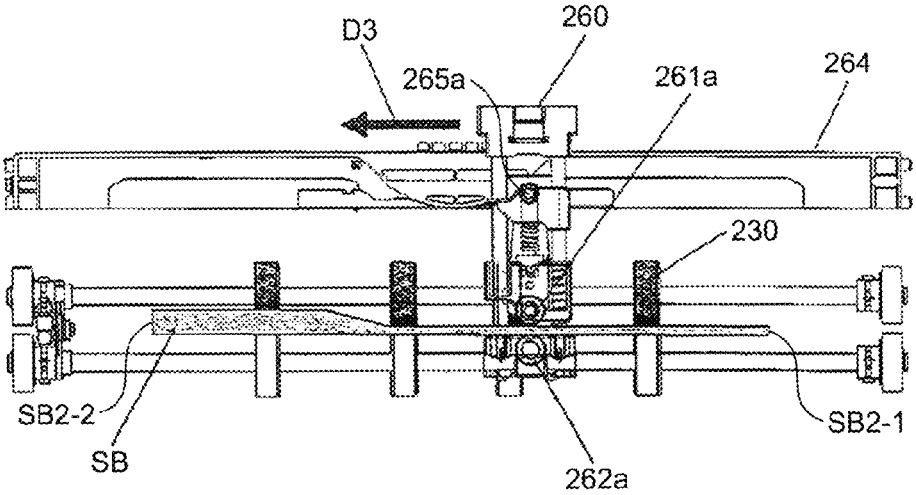
FIG. 19 is an operation descriptive diagram illustrating a state where the additional folding roller unit starts the backward movement and reaches a sixth guide path.
Figure 20:
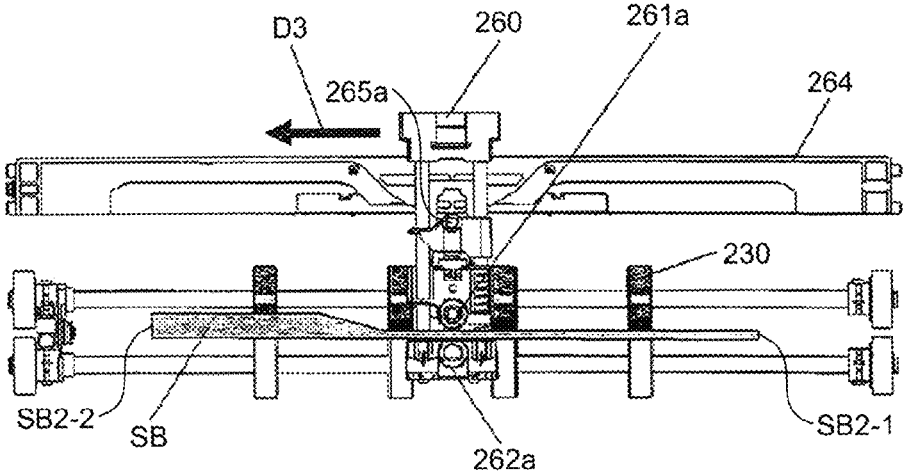
FIG. 20 is an operation descriptive diagram illustrating a state where the additional folding roller unit reaches the sixth guide path and shifts to be in a pressurizing state from a non-pressurizing state.
Figure 21:
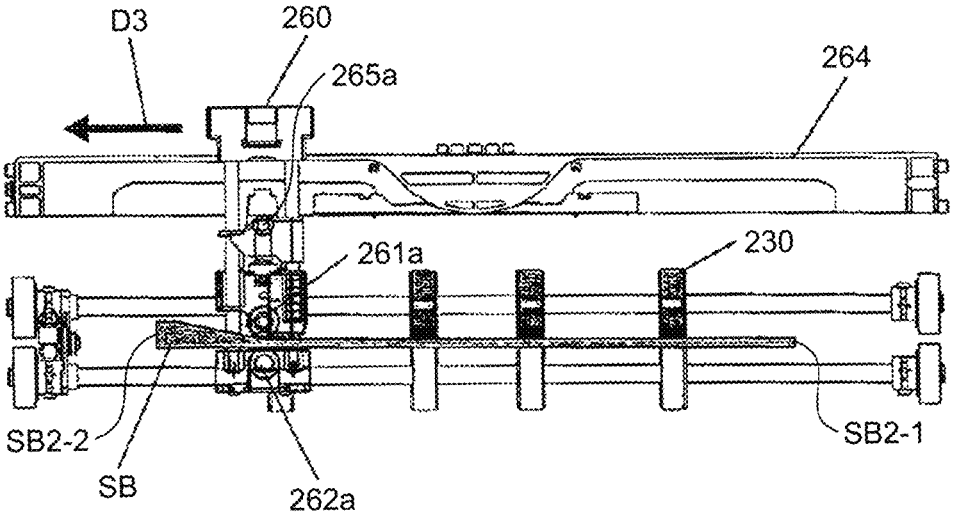
FIG. 21 is an operation descriptive diagram illustrating a state where the additional folding roller unit enters the sixth guide path and is made to be in the pressurizing state completely.

Next, the additional folding roller unit 260 starts backward movement by the unit movement mechanism 263 (FIG. 18). In the backward movement, the pressure mechanism 265 moves in the leftward direction (direction indicated by an arrowed line D3) in FIG. 18 along the fourth guide path 274. When the pressure mechanism 265 reaches the sixth guide path 276 with the movement (FIG. 19), the guide pin 265*a* is pressed downward along the shape of the sixth guide path 276 and the pressure mechanism 265 shifts to be in the pressurizing state from the non-pressurizing state (FIG. 20).

Figure 22:
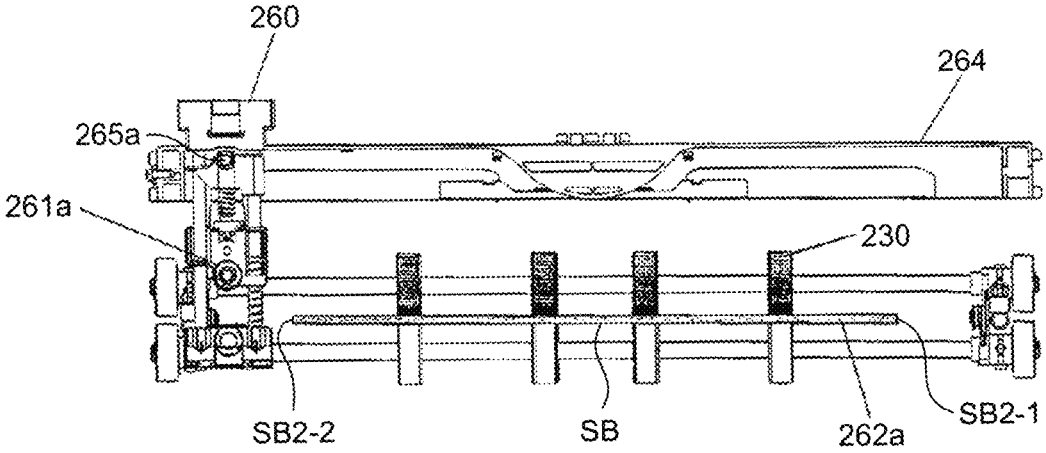
FIG. 22 is an operation descriptive diagram illustrating a state where the additional folding roller unit moves on the fifth guide path as it is and returns to an initial position.

Then, when the pressure mechanism 265 enters the fifth guide path 275, the pressure mechanism 265 is made into a complete pressurizing state and moves on the fifth guide path 275 in the direction indicated by the arrowed line D3 (FIG. 21), and passes through the sheet bundle SB (FIG. 22).

In this manner, the additional folding roller unit 260 is made to reciprocate so as to perform additional folding on the sheet bundle SB. In this case, the additional folding roller unit 260 starts additional folding from the center portion of the sheet bundle SB in one direction and passes through one end SB2-1 of the sheet bundle SB. Thereafter, the additional folding roller unit 260 passes on the sheet bundle SB subjected to the additional folding. Subsequently, the additional folding roller unit 260 starts additional folding from the center portion of the sheet bundle SB in the other direction and passes through the other end SB2-2. With this operation, the additional folding roller unit 260 performs the additional folding on the sheet bundle SB.

In the above-described operation, when the additional folding roller unit 260 starts the additional folding or returns in the other direction after passing through the one end SB2-1, the pair of additional folding rollers 261*a* and 262*a* do not make contact with or pressurize the ends SB2-1, and SB2-2 of the sheet bundle SB from the outer sides of the sheet bundle SB. That is to say, when the additional folding roller unit 260 passes through the ends SB2-1 and SB2-2 of the sheet bundle SB from the outer sides of the ends, the additional folding roller unit 260 is in the non-pressurizing state. With this configuration, no damage is caused on the ends SB2-1 and SB2-2 of the sheet bundle SB. Furthermore, the additional folding is performed on the sheet bundle SB from the vicinity of the center portion to the ends SB2-1 and SB2-2, so that a distance for which the additional folding roller unit 260 travels while making contact with the sheet bundle SB at the time of the additional folding becomes short. With this configuration, deflection causing wrinkles and the like is not easy to be accumulated. This prevents damage from being caused on the ends SB2-1 and SB2-2 of the sheet bundle SB when additional folding is performed on the fold line portion (back) SB1 of the sheet bundle SB. This can suppress generation of flipping and wrinkles on the fold line portion SB1 and the vicinity thereof due to the accumulation of deflection.

In order to prevent the pair of additional folding rollers 261*a* and 262*a* from climbing on the ends SB2-1 and SB2-2 of the sheet bundle SB from the outer sides of the ends SB2-1 and SB2-2, the pair of additional folding rollers 261*a* and 262*a* are made to operate as illustrated in FIG. 12 to FIG. 22. A distance by which the additional folding roller unit 260 moves on the sheet bundle in the non-pressurizing state in the forward movement is assumed to be La, and a distance by which the additional folding roller unit 260 moves on the sheet bundle in the non-pressurizing state in the backward movement is assumed to be Lb. Under the assumption, it is essential that relation between the length L of the sheet bundle in the width direction and the distances La and Lb satisfies L>La+Lb (FIG. 12 to FIG. 14, FIG. 17 to FIG. 19).

It is desirable that the distances La and Lb are set to be substantially the same and the additional folding roller unit 260 starts pressing in the vicinity of the center portion of the sheet bundle SB in the width direction (FIG. 16, FIG. 20).

It is to be noted that the additional folding roller unit 260 in the embodiment is provided with the additional folding roller lower unit 262 and performs additional folding by the pair of additional folding roller 261*a* and 262*a*. Alternatively, the additional folding roller unit 260 may have the following configuration. That is, the additional folding roller lower unit 262 is not provided, and the additional folding roller upper unit 261 and a bearing member (not illustrated) having an abutment surface that is opposed to the additional folding roller upper unit 261 are provided so as to press the sheet bundle therebetween.

Furthermore, the additional folding roller unit 260 in the embodiment has a configuration in which the additional folding roller upper unit 261 is movable upwardly and downwardly and the additional folding roller lower unit 262 is unmovable upwardly and downwardly. Alternatively, the additional folding roller lower unit 262 can be also configured to be movable upwardly and downwardly. With this configuration, the pair of additional folding rollers 261*a* and 262*a* operate to make contact with and be separated from each other symmetrically with respect to the additional folding position. This makes the additional folding position constant regardless of the thickness of the sheet bundle SB and can further suppress damages such as scratches.

Figure 23:
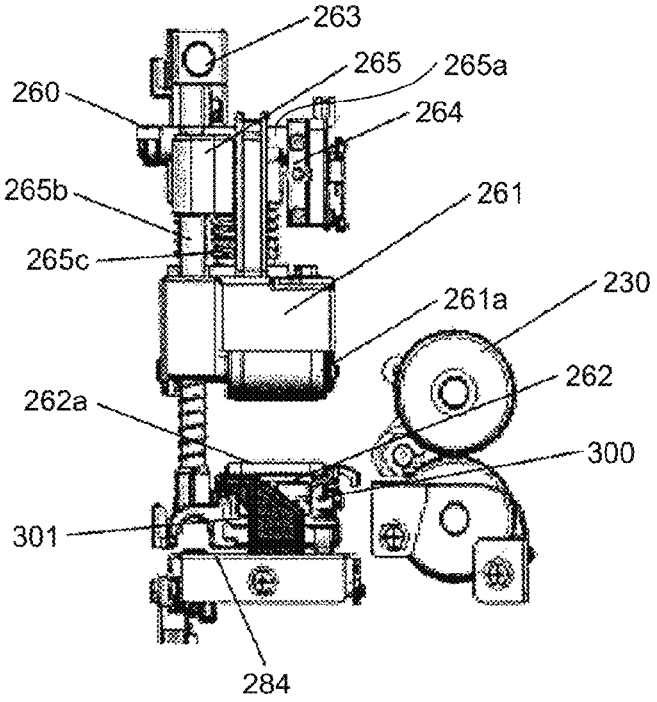
FIG. 23 is a front view illustrating configurations of the additional folding roller unit and a sheet supporting device.
Figure 24:
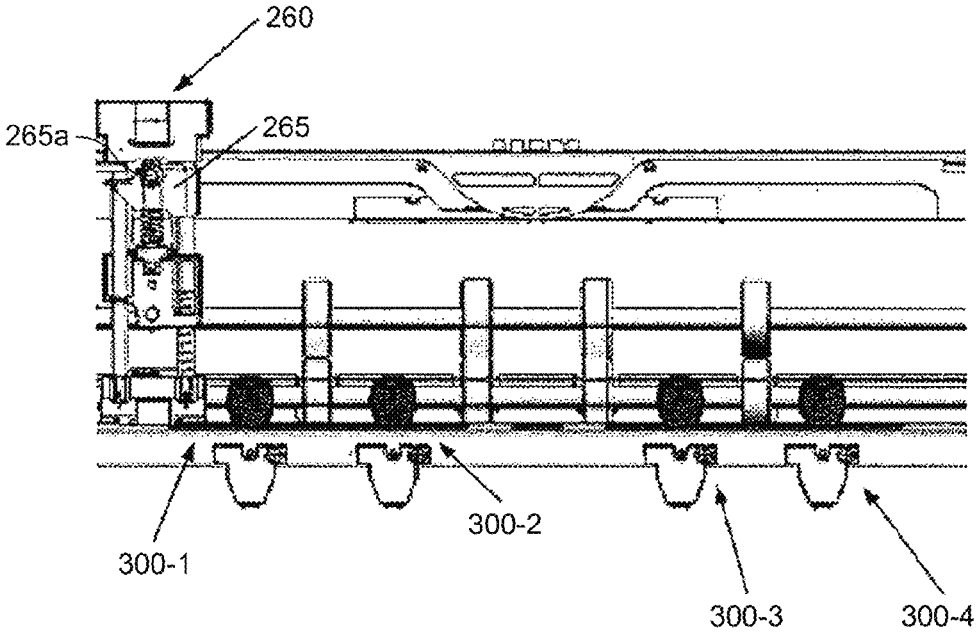
FIG. 24 is a side view illustrating main parts when
Figure 25:
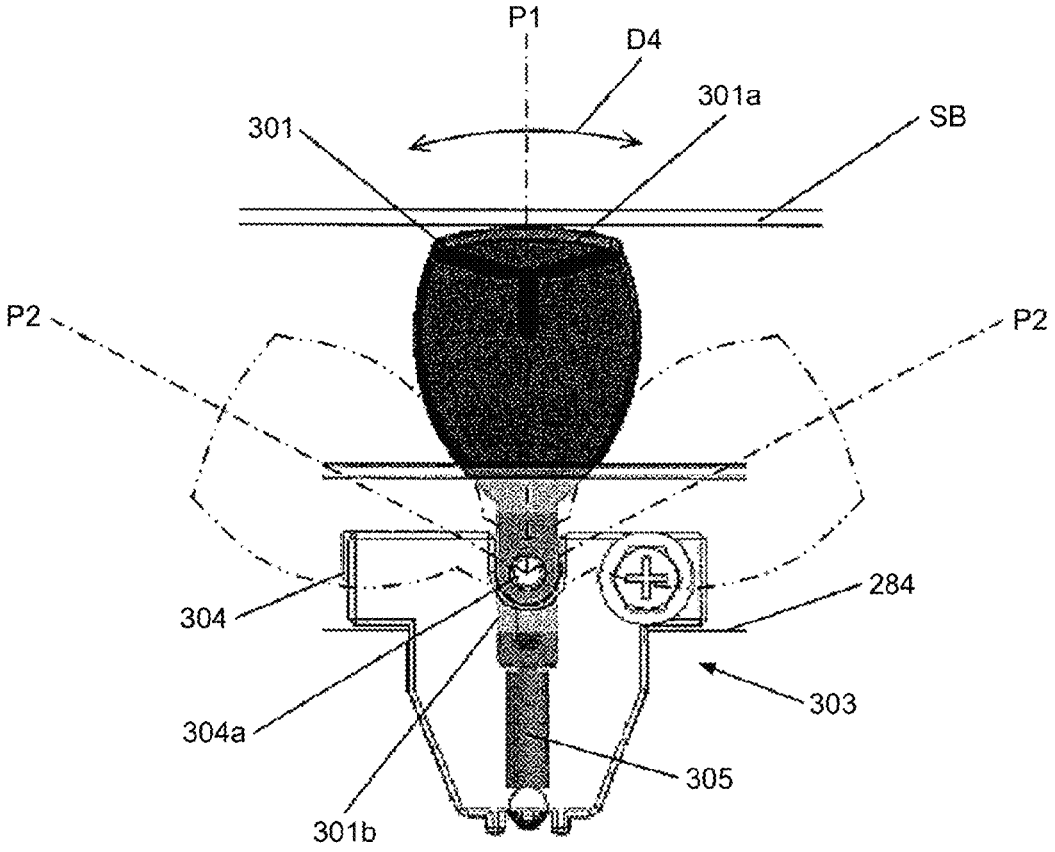
FIG. 25 is an enlarged view illustrating main parts including a supporting mechanism of a supporting member in the sheet supporting device.

FIG. 23 is a front view illustrating configurations of the additional folding roller unit and the sheet supporting device in the embodiment. FIG. 24 is a side view illustrating main parts when FIG. 23 is viewed from the left side (discharge side). FIG. 25 is an enlarged view illustrating main parts including a supporting mechanism of the supporting member in the sheet supporting device.

In these drawings, sheet supporting devices 300 include supporting members 301 and supporting mechanisms 303. As illustrated in FIG. 24, the sheet supporting devices 300 are located on the movement path of the additional folding roller unit 260. In the embodiment, the sheet supporting devices 300 are provided as first to fourth sheet supporting devices 300-1, 300-2, 300-3, and 300-4 at four places. Although the sheet supporting devices 300 are installed at four places in the embodiment, it is sufficient that the sheet supporting devices 300 are installed at equal to or more than two places and the number of sheet supporting devices 300 are set appropriately based on the maximum width dimension of the sheet bundle that is processed.

As illustrated in FIG. 25, each supporting mechanism 303 includes the supporting member 301, a bearing member 304, and a tension spring 305. The bearing member 304 is a member that supports and receives another member. The supporting member 301 is borne on the bearing member 304 through a support shaft 304*a* so as to swing in the travelling direction of the additional folding roller unit 260. The supporting member 301 includes a supporting surface 301*a* with which the sheet bundle SB makes contact on the upper surface thereof. The tension spring 305 is coupled to an extension portion 301*b* extending to the side opposite to the supporting surface 301*a* from the support shaft 304*a*. The supporting surface 301*a* has a fan-shaped curved surface about a rotating fulcrum of the support shaft 304*a*. When the supporting surface 301*a* stops at a supporting position P1 in an inclined state, the supporting surface 301*a* can make contact with the lower surface of the sheet bundle SB in a constant supporting shape all the time to support the sheet bundle SB. The bearing member 304 is attached to a stay 284 as a structure of the saddle stitching binding device 2 at the lower side of the discharging conveying path 244 such that the supporting surface 301*a* projects to the discharging conveying path 244.

The initial position of each supporting member 301 corresponds to the position as illustrated in FIG. 25. The supporting member 301 is held at the position by an elastic force of the tension spring 305. The position corresponds to the supporting position P1 of the sheet bundle SB. When the additional folding roller unit 260 abuts against the side surface of the supporting member 301 from this position, the supporting member 301 is pressed to be inclined and retreats to an inclined retreat position P2 (see FIG. 30) from the supporting position P1. When the additional folding roller unit 260 climbs over and passes through the supporting member 301, the supporting member 301 returns to the supporting position P1 by the elastic force of the tension spring 305. That is to say, the supporting member 301 swings in a direction indicated by an arrowed line D4 in FIG. 25 with the movement of the additional folding roller unit 260 so as to be located at the supporting position P1 of the sheet bundle SB or the retreat position P2 from the sheet bundle SB.

The sheet supporting devices 300 are located on the movement path of the additional folding roller unit 260 as described above. When the additional folding roller unit 260 is located at the outside of the width of the sheet bundle SB, all the sheet supporting devices 300 are located at the supporting positions P1 supporting the lower surface side of the sheet bundle SB. With this configuration, when the sheet bundle SB is received and discharged, the sheet bundle SB makes contact with the supporting surfaces 301*a* of all the sheet supporting devices 300 and bowing of the front end and drooping of the rear end are supported by the supporting surfaces 301*a*. As a result, preferable conveyance performance is ensured.

FIG. 26 to FIG. 29 are operation descriptive views illustrating operations of the sheet supporting devices 300.

Figure 26:
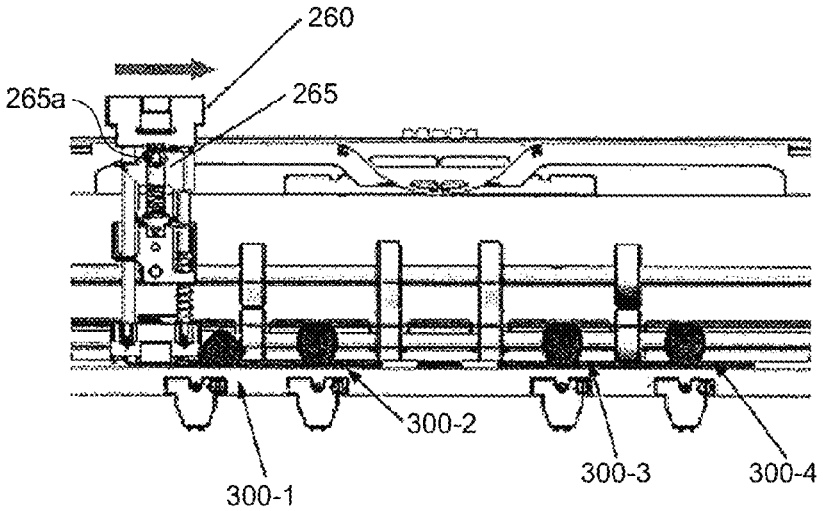
FIG. 26 is an operation descriptive diagram illustrating a state where the additional folding roller unit moves forward and a first sheet supporting device moves to a retreat position.
Figure 27:
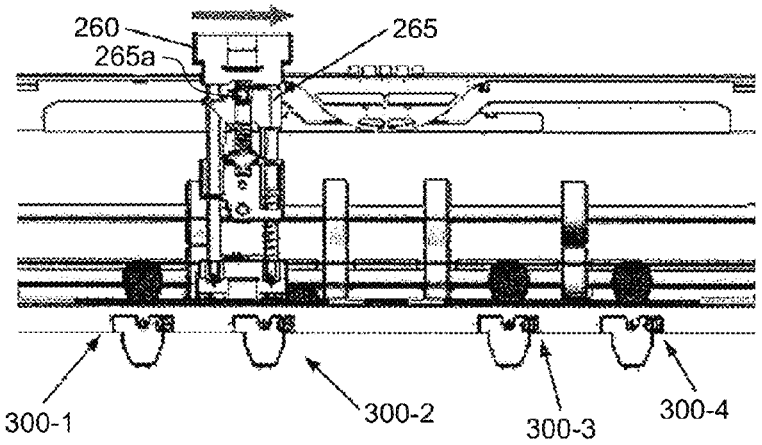
FIG. 27 is an operation descriptive diagram illustrating a state where the additional folding roller unit moves forward, the first sheet supporting device returns to a supporting position, and a second sheet supporting device moves to a retreat position.
Figure 28:
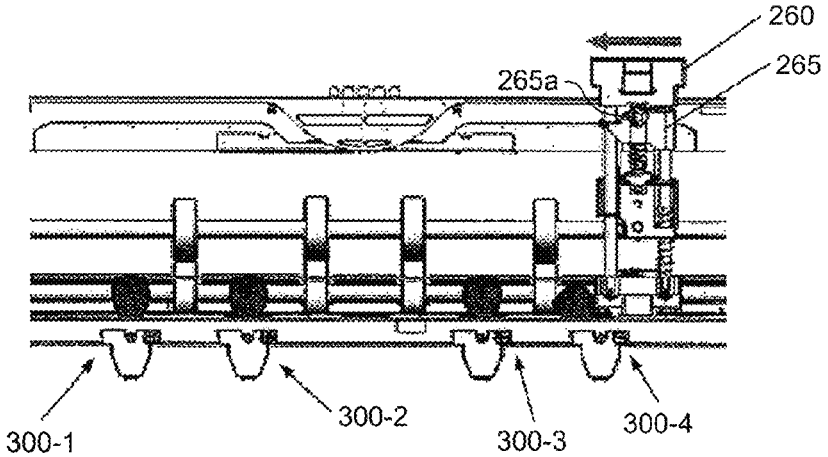
FIG. 28 is an operation descriptive diagram illustrating a state where the additional folding roller unit moves backward and a fourth sheet supporting device moves to a retreat position.
Figure 29:
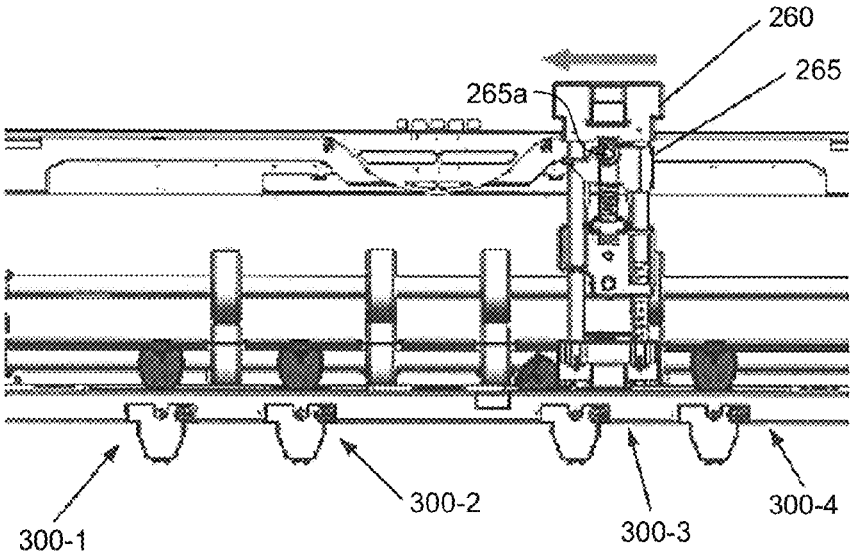
FIG. 29 is an operation descriptive diagram illustrating a state where the additional folding roller unit moves backward, the fourth sheet supporting device returns to a supporting position, and the second sheet supporting device moves to the retreat position.

FIG. 26 and FIG. 27 illustrate the operations of the sheet supporting devices 300 when the additional folding roller unit 260 moves forward. FIG. 28 and FIG. 29 illustrate the operations of the sheet supporting devices 300 when the additional folding roller unit 260 moves backward.

The four sheet supporting devices 300 are provided as the first to fourth sheet supporting devices (300-1, 300-2, 300-3, 300-4) and are driven independently. When the additional folding roller unit 260 moves along the fold line portion SB1 of the sheet bundle SB, first, the additional folding roller unit 260 abuts against the supporting member 301 of the first sheet supporting device 300-1 located at the most upstream side in the movement direction of the movement position of the additional folding roller unit 260. The supporting member 301 is pushed by the abutting additional folding roller unit 260 to be moved to the retreat position P2 (FIG. 26). Then, when the additional folding roller unit 260 passes through it, the supporting member 301 returns from the retreat position P2 to the supporting position P1.

The supporting member 301 of the second sheet supporting device 300-2 located at the downstream side of the first sheet supporting device 300-1 in the movement direction of the movement position is pushed by the additional folding roller unit 260 to be moved to the retreat position P2 (FIG. 27). The operation is repeated to the fourth sheet supporting device 300-4 at the most downstream side in the movement direction.

When the additional folding roller unit 260 moves in the backward direction, the additional folding roller unit 260 starts moving from the backward movement start position in the same manner. The additional folding roller unit 260 pushes the supporting member 301 of the fourth sheet supporting device 300-4 down in the backward movement direction so as to move it to the retreat position P2 (FIG. 28). When the additional folding roller unit 260 passes through the fourth sheet supporting device 300-4, the additional folding roller unit 260 pushes the supporting member of the third sheet supporting device 300-3 down so as to move it to the retreat position P2 (FIG. 29). The supporting member 301 of the fourth sheet supporting device 300-4 returns to the supporting position P1 upon the passage of the additional folding roller unit 260. The operation is repeated to the first sheet supporting device 300-1.

Accordingly, the retreat position P2 take two positions of the position in the forward movement and the position in the backward movement.

With this operation, the supporting members 301 of the sheet supporting devices 300 at which the additional folding roller unit 260 does not arrive are located at the supporting positions P1. With this configuration, these sheet supporting devices 300 can support drooping of the sheet bundle SB in the width direction.

Figure 30:
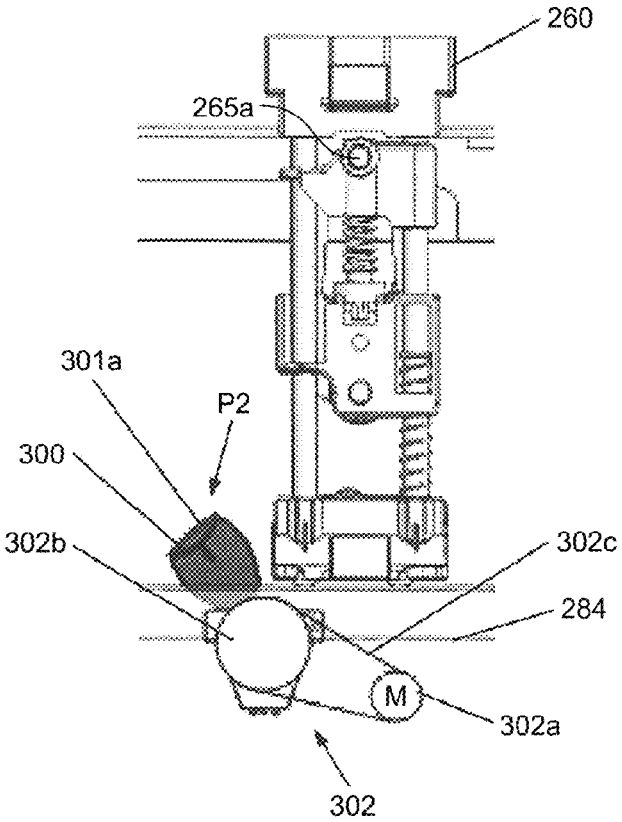
FIG. 30 is a diagram illustrating an example in which a swing operation of the supporting member between the supporting position and the retreat position is performed by a driving mechanism that is driven by a motor.

FIG. 30 is a view illustrating an example in which a swing operation of each supporting member 301 is performed by a driving mechanism 302 that is driven by a motor. FIG. 30 is a side view illustrating main parts when the additional folding roller unit 260 and the driving mechanism 302 are viewed from the discharge side.

As illustrated in FIG. 30, the driving mechanism 302 includes a motor 302*a*, a driven pulley 302*b*, and a timing belt 302*c*. The driven pulley 302*b* is provided so as to be integrally rotatable coaxially with the support shaft 304*a*. The timing belt 302*c* is wound over between a driving pulley (indicated as the motor 302*a* in FIG. 30) that is attached to the rotating shaft of the motor 302*a* and the driven pulley 302*b* so as to rotate integrally at a reduction ratio. The reduction ratio of the timing belt 302*c* is set previously in accordance with the rotation of the motor 302*a*.

The driving mechanism 302 drives the supporting member 301 in a swing manner in accordance with the rotation of the motor 302*a* so as to move the supporting member 301 to the retreat position P2 or the supporting position P1. The supporting member 301 is moved to the retreat position P2 when the additional folding roller unit 260 comes closer thereto. The supporting member 301 is moved to the supporting position P1 after the additional folding roller unit 260 passes through the supporting portion 301. The movement is repeated for the sheet supporting devices 300-1 to 300-4 at the most upstream side to the most downstream side in the movement direction in the forward movement and the backward movement. The operations that are the same as the operations as illustrated in FIG. 26 to FIG. 29 can be thus performed.

Figure 31:
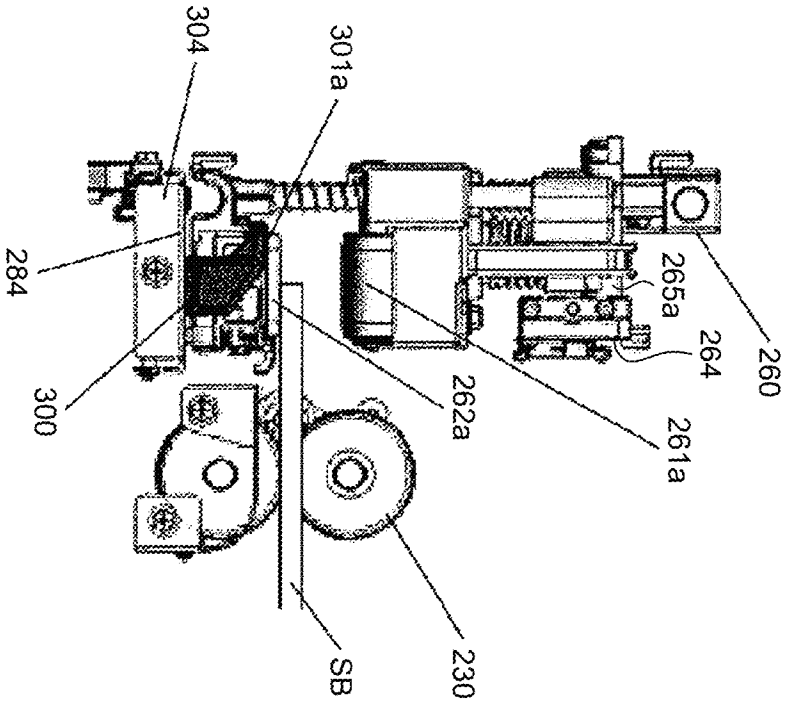
FIG. 31 is a diagram for explaining positional relation among the additional folding roller unit, the sheet bundle, and the sheet supporting device at the time of additional folding.

FIG. 31 illustrates positional relation between the sheet bundle SB and each sheet supporting device 300 at the time of additional folding. The supporting surface 301*a* of the supporting member 301 at the supporting position P1 is located at the lower position relative to the uppermost position of the additional folding lower roller 262*a*. That is to say, a space is provided between the supporting surface 301*a* of the supporting member 301 and the lower surface of the sheet bundle SB such that they do not make contact with each other in an initial state. With this configuration, when the supporting member 301 moves to the supporting position P1 from the retreat position P2 after the additional folding roller unit 260 passes through it, the supporting surface 301*a* does not make contact with the lower surface of the sheet bundle SB. They make contact with each other after the supporting member 301 returns to the supporting position P1 and is made into an unmovable state.

That is to say, the sheet bundle SB is made into a drooping state from the nip position between the pair of folding rollers 230 with the gravity force when it is conveyed. In this state, the sheet bundle SB makes contact with the supporting surface 301*a*. The additional folding roller unit 260 moves to the position separated from the supporting portion 301 at this time. With this configuration, the supporting surface 301*a* does not make contact with the sheet bundle SB that moves in the discharge direction from the direction orthogonal to the discharge direction. In this manner, scratches and contaminants due to friction on the sheet bundle SB are prevented from being generated.

As described above, according to the embodiment, the following effects are obtained.

1. The saddle stitching binding device 2 (sheet processing device) including the additional folding roller unit 260 (pressing unit) that presses the fold line portion SB1 of the folded sheet bundle SB, and performs additional folding, and the unit movement mechanism 263 (movement unit) that causes the additional folding roller unit 260 to reciprocate in the width direction of the sheet bundle SB. The saddle stitching binding device 2 (sheet processing device) further includes the sheet supporting device 300 (supporting unit) that is located on the movement path of the additional folding roller unit 260 and supports the lower surface side of the sheet bundle SB when the sheet bundle SB after pressed is conveyed to the downstream side. In the saddle stitching binding device 2, the supporting position P1 at which the sheet supporting device 300 supports the sheet bundle SB and the retreat position P2 at which the sheet supporting device 300 permits the pressing unit to move are set to the sheet supporting device 300. That is, the sheet supporting device 300 can support the sheet bundle SB while permitting the additional folding roller unit 260 to move. With this configuration, additional folding can be performed on the fold portion reliably while guaranteeing folding quality of the fold portion.

2. The sheet supporting device 300 moves between the supporting position P1 and the retreat position P2 in accordance with the movement of the additional folding roller unit 260. This configuration can provide the same effects as in the above aspect 1.

3. A plurality of sheet supporting devices 300 are provided on the movement path and the respective sheet supporting devices 300 move between the supporting positions P1 and the retreat positions P2 independently. The sheet supporting device 300 to which the additional folding roller unit 260 comes retreats but other sheet supporting devices 300 can support the sheet bundle.

4. When the additional folding roller unit 260 is located at the outside position of the sheet width, all the sheet supporting devices 300-1 to 300-4 are located at the supporting positions P1. That is, all the sheet supporting devices 300-1 to 300-4 can support bowing of the front end and drooping of the rear end of the sheet bundle SB when the sheet bundle SB is received and discharged. This can guarantee preferable conveyance performance.

5. The sheet supporting devices 300-1 to 300-4 move from the supporting positions P1 to the retreat positions P2 sequentially in accordance with the movement position of the additional folding roller unit 260. The sheet supporting devices 300 at which the additional folding roller unit 260 does not arrive are located at the supporting positions P1. With this configuration, these sheet supporting devices 300 can support drooping of the sheet bundle SB in the width direction.

6. The sheet supporting device 300 is pushed by the additional folding roller unit 260 so as to move from the supporting position P1 to the retreat position P2 when the additional folding roller unit 260 moves. This eliminates necessity of control for moving the sheet supporting device 300 to the retreat position P2. With this configuration, the sheet supporting device 300 can be moved to the retreat position P2 from the supporting position P1 only by the mechanical operation.

7. After the additional folding roller unit 260 further moves from the retreat state of the sheet supporting device 300 and passes through the sheet supporting device 300, the sheet supporting device 300 returns to the supporting position P1. This eliminates necessity of control for moving the sheet supporting device 300 to the supporting position P1. With this configuration, the sheet supporting device 300 can be made to return to the supporting position P1 from the retreat position P2 only by the mechanical operation.

8. The sheet supporting device 300 includes the supporting surface 301*a* supporting the sheet bundle SB, the support shaft 304*a* (rotating fulcrum) supporting the supporting member 301 (supporting unit) in a rotatable manner, and the tension spring 305 (unit that applies a rotation force) that applies the rotation force in the direction opposite to the rotating direction of the supporting surface 301*a* about the support shaft 304*a*. The sheet supporting device 300 moves between the supporting position P1 and the retreat position P2 about the support shaft 304*a*. With this configuration, a direct driving force is not necessary for moving the sheet supporting device 300 between the supporting position P1 and the retreat position P2.

9. The supporting surface 301*a* of the sheet supporting device 300 at the supporting position P1 is located at the lower position relative to an uppermost contact position between the additional folding lower roller 262*a* of the additional folding roller unit 260 and the lower surface of the sheet bundle SB. With this configuration, when the supporting portion 301 of the sheet supporting device 300 moves to the supporting position P1 from the retreat position P2, the supporting portion 301 does not make contact with the sheet bundle SB. This prevents scratches and contaminants due to friction on the sheet bundle SB from being generated.

In the scope of the invention, the sheet bundle corresponds to the reference numeral SB in the embodiment. A fold line portion corresponds to the reference numeral SB1, a pressing unit corresponds to the additional folding unit 260, a movement unit corresponds to the unit movement mechanism 263, a sheet processing device corresponds to the saddle stitching binding device 2, a supporting unit corresponds to the sheet supporting devices 300, 300-1 to 300-4 including the supporting member(s) 301, a supporting position corresponds to the reference numeral P1, a retreat position corresponds to the reference numeral P2, a supporting surface corresponds to the reference numeral 301*a*, a rotating fulcrum corresponds to the support shaft 304*a*, a unit that applies a rotation force corresponds to the tension spring 305, a contact position between the lower side of the pressing unit and the lower surface of the sheet bundle corresponds to the uppermost position of the additional folding lower roller 262*a*, and an image forming system corresponds to the system constituted by the saddle stitching binding device 2 and the image forming apparatus PR.

According to the invention, additional folding can be performed on a fold portion reliably while guaranteeing folding quality of the fold portion.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing device comprising:

a pressing unit configured to press a fold line portion of a folded sheet bundle and perform additional folding;

a movement unit configured to cause the pressing unit to reciprocate in a width direction of the sheet bundle; and a supporting unit configured to be located on a movement path of the pressing unit and supports a lower surface side of the sheet bundle when the sheet bundle after pressed is conveyed to a downstream side, wherein a supporting position at which the supporting unit supports the sheet bundle and a retreat position at which the supporting unit permits the pressing unit to move are set to the supporting unit.

2. The sheet processing device according to claim 1, wherein the supporting unit moves between the supporting position and the retreat position in accordance with movement of the pressing unit.

3. The sheet processing device according to claim 1, wherein the supporting unit is provided in plurality on the movement path, and the respective supporting units move between the supporting positions and the retreat positions independently.

4. The sheet processing device according to claim 3, wherein all the supporting units are located at the supporting positions when the pressing unit is located at an outside position of a sheet width.

5. The sheet processing device according to claim 3, wherein the supporting units move from the supporting positions to the retreat positions sequentially in accordance with a movement position of the pressing unit.

6. The sheet processing device according to claim 1, wherein the supporting unit is pushed by the pressing unit so as to move from the supporting position to the retreat position while the pressing unit is moving.

7. The sheet processing device according to claim 6, wherein after the pressing unit further moves from the retreat position of the supporting unit and passes through the supporting unit, the supporting unit returns to the supporting position.

8. The sheet processing device according to claim 1, wherein the supporting unit includes a supporting surface supporting the sheet bundle, a rotating fulcrum supporting the supporting unit in a rotatable manner, and a unit that applies a rotation force in a direction opposite to a rotating direction of the supporting surface about the rotating fulcrum, and moves between the supporting position and the retreat position about the rotating fulcrum.

9. The sheet processing device according to claim 1, wherein the supporting surface of the supporting unit at the supporting position is located at a lower position relative to a contact position between a lower side of the pressing unit and a lower surface of the sheet bundle.

10. An image forming system including a sheet processing device, wherein the sheet processing device comprises:

a pressing unit configured to press a fold line portion of a folded sheet bundle and perform additional folding;

a movement unit configured to cause the pressing unit to reciprocate in a width direction of the sheet bundle; and a supporting unit configured to be located on a movement path of the pressing unit and supports a lower surface side of the sheet bundle when the sheet bundle after pressed is conveyed to a downstream side, wherein a supporting position at which the supporting unit supports the sheet bundle and a retreat position at which the supporting unit permits the pressing unit to move are set to the supporting unit.

* * * * *